US006676102B1

(12) United States Patent
Hambelton

(10) Patent No.: US 6,676,102 B1
(45) Date of Patent: Jan. 13, 2004

(54) ADJUSTABLE MODULAR FORM SYSTEM AND METHOD FOR RECTILINEAR CONCRETE COLUMN FORM

(75) Inventor: John J. Hambelton, Denton, TX (US)

(73) Assignee: Symons Corporation, Des Plaines, IL (US)

( * ) Notice: Subject to any disclaimer, the term of this patent is extended or adjusted under 35 U.S.C. 154(b) by 0 days.

(21) Appl. No.: 09/507,329

(22) Filed: Feb. 18, 2000

(51) Int. Cl.[7] ..... E04G 13/02; B28B 7/02

(52) U.S. Cl. ..... 249/49; 249/48; 249/155; 249/189; 249/192; 52/578

(58) Field of Search ..... 249/48, 49, 189, 249/192, 216, 218, 219.1, 155, 165; 52/576, 577, 578, 579

(56) References Cited

U.S. PATENT DOCUMENTS

| | | | | | |
|---|---|---|---|---|---|
| 2,008,162 | A | * | 7/1935 | Waddell | 249/48 X |
| 2,583,168 | A | * | 1/1952 | Sato | 249/49 |
| 2,595,286 | A | * | 5/1952 | Otte et al. | 249/49 |
| 3,002,250 | A | * | 10/1961 | Huet | 249/48 X |
| 3,021,586 | A | * | 2/1962 | Uruburu | 249/48 |
| 3,066,962 | A | * | 12/1962 | Koehler | 249/48 X |
| 3,591,124 | A | * | 7/1971 | Haslett | 249/48 |
| 3,795,393 | A | * | 3/1974 | Melfi | 249/48 X |
| 3,841,597 | A | * | 10/1974 | Butts et al. | 249/30 |
| 3,857,540 | A | * | 12/1974 | Ecker | 249/48 |
| 3,917,216 | A | * | 11/1975 | Plough | 249/48 |
| 3,945,601 | A | * | 3/1976 | Rowley | 249/48 |
| 4,356,993 | A | * | 11/1982 | Gallis et al. | 249/27 |
| 4,958,800 | A | * | 9/1990 | Carlson | 249/219.1 |
| 4,974,700 | A | * | 12/1990 | Gates | 182/128 |
| 5,195,293 | A | * | 3/1993 | diGirolamo et al. | 52/745.13 |
| 5,632,923 | A | * | 5/1997 | Hayakawa | 249/47 |
| 6,041,561 | A | * | 3/2000 | LeBlang | 52/234 |

FOREIGN PATENT DOCUMENTS

| | | | | |
|---|---|---|---|---|
| EP | 237874 A2 | * | 3/1987 | 249/48 |
| FR | 1425126 | | 12/1965 | |
| GB | 1183500 | | 3/1970 | |
| JP | 247676 A | * | 9/1995 | |

OTHER PUBLICATIONS

International Search Report from PCT, PCT Appl. No. PCT/US01/05201, mailed Jun. 18, 2001.

* cited by examiner

*Primary Examiner*—Jong-Suk James Lee
(74) *Attorney, Agent, or Firm*—Wood, Herron & Evans, LLP

(57) ABSTRACT

A modular form panel and a method of employing the same are provided for use when forming a rectilinear concrete column form. The form panel comprises a first side edge and a second side edge, with the first side edge having a plurality of attachment holes arranged in a plurality of vertically oriented gage lines. The form panel also includes a top edge and a bottom edge extending between the first and second side edges, and has a generally planar interconnecting skin, with the skin having a plurality of attachment holes arranged in a plurality of vertically oriented gage lines. Thus, a plurality of like panels may be arranged to define a rectilinear column form of predetermined cross-sectional dimensions by securing the first edge of the panel to the skin of an adjacent like panel by attaching a selected one of the first edge gage lines to a selected one of the skin gage lines on the adjacent like panel.

31 Claims, 12 Drawing Sheets

ADJUSTABLE MODULAR FORM SYSTEM AND METHOD FOR RECTILINEAR CONCRETE COLUMN FORM

FIELD OF THE INVENTION

The present invention relates to form panels for forming concrete columns and to a forming system employing such form panels.

BACKGROUND OF THE INVENTION

In concrete construction modular forming systems for forming concrete walls are generally well known in the art. Modular forming systems for concrete walls are generally favored by contractors because such modular systems permit the rapid assembly, disassembly, and reuse of the forms, thus offering significant savings in terms of time, labor, and materials. Moreover, the use of a discrete number of pre-manufactured wall form sections permits the construction of wall having different height, length, and thickness simply by choosing modular sections of the desired size.

When constructing concrete buildings or other structures, it would be desirable to extend the cost savings afforded by modular construction of wall forms to the modular construction of column forms. Modular construction of concrete column forms would cut waste by saving concrete due to the fact that each individual column could be constructed to its own specifications, rather than overbuilding some of the columns to take advantage of existing form sizes. Ideally, such a modular column form system would minimize surface irregularities, which in turn improves the concrete cover over the reinforcing steel. Such a modular column form would also accommodate high pour pressures with minimal external stiffening or reinforcement.

SUMMARY OF THE INVENTION

In accordance with a first aspect of the invention, a modular form panel is provided for use when forming a rectilinear concrete column form. The form panel comprises a first side edge and a second side edge, with the first side edge having a plurality of attachment holes arranged in a plurality of vertically oriented gage lines. The form panel also includes a top edge and a bottom edge extending between the first and second side edges, and has a generally planar interconnecting skin, with the skin having a plurality of attachment holes arranged in a plurality of vertically oriented gage lines. Thus, a plurality of like panels may be arranged to define a rectilinear column form of predetermined cross-sectional dimensions by securing the first edge of the panel to the skin of an adjacent like panel by attaching a selected one of the first edge gage lines to a selected one of the skin gage lines on the adjacent like panel.

In further accordance with a preferred embodiment, the first side edge of the panel includes an edge stiffener. Preferably, the edge stiffener is an L-shaped member, and further may be widened or otherwise be constructed to form an abutting surface adapted for abutting contact with the skin of the adjacent panel.

Still preferably, the panel first edge gage lines are spaced apart a first distance and the skin gage lines are spaced apart a second distance, with the first distance being less than the second distance. In a preferred embodiment, the panel first edge gage lines are spaced apart a distance of between about 2 inches and about 3 inches, and the skin gage lines are spaced apart a distance of between about 4 inches and about 6 inches.

When the panel is assembled with like panels, at least one of the skin gage lines may be unused, and thus a plug may be provided which is adapted for placement in any unused attachment holes. The unused attachment holes will preferably include a countersunk portion, and the plug preferably includes a shank and a head. The head of the plug will include an end surface and will be sized to fit in the countersunk portion so that the plug head cooperates with the skin to form a generally uninterrupted planar surface.

The panel will preferably includes a top stiffener adjacent the top edge and a bottom stiffener adjacent the bottom edge, with the top and bottom stiffeners extending between the first and second side edges. The panel may also include at least one intermediate stiffener extending between the first and second side edges. Preferably, each of the top, bottom, and intermediate stiffener are Z-shaped members, and still preferably the Z-shaped members may be substantially identical. Each of the attachment holes may be positioned or located so as to extend through one of the stiffeners.

In accordance with a second aspect of the invention, an adjustable modular form system is provided for constructing a rectilinear column form having a desired one of a plurality of available cross-sectional dimensions. The system comprises a plurality of form panels, with each of the form panels having first and second side edges, top and bottom edges, and a generally planar interconnecting skin. The first side edge of each panel includes a plurality of attachment holes arranged in a plurality of vertically oriented gage lines, and the skin of each panel includes a plurality of attachment holes arranged in a plurality of vertically oriented gage lines. Accordingly, upon attaching the first side edge of each of the panels along a selected one of the side edge gage lines to the skin of its adjacent panel along a selected one of the skin gage lines the panels are arranged to create the generally rectilinear column form having the desired cross-sectional dimensions.

In accordance with another aspect of the invention, a concrete column form comprises a plurality of form panels, with each of the form panels having first and second side edges, top and bottom edges, and a generally planar interconnecting skin. Adjustable joining means are provided for adjustably joining the panels to each other to produce a generally rectilinear column form having a desired one of a plurality of rectilinear cross-sections. The adjustable joining means is defined in part by a portion of the first side edge of each of the panels and a cooperating portion of the skin of an adjacent panel.

In accordance with yet another aspect of the invention, an adjustable forming system is provided for constructing a concrete column form having a desired one of a plurality of available cross-sectional dimensions. The system comprises a plurality of form panels, with each of the form panels having first and second side edges, top and bottom edges, and a generally planar interconnecting skin. The first side edge of each of the form panels is adapted to define a plurality of attachment lines, and the skin of each of the panels also is adapted to define a plurality of attachment lines. Accordingly, the column form having the desired cross-sectional dimensions may be assembled upon securing a selected one of the first side edge attachment lines on each of the panels to a selected one of the skin attachment lines on an adjacent panel.

In accordance with a still further aspect of the invention, a method of constructing a concrete column form having a desired one of a plurality of available cross-sectional dimensions comprises the steps of choosing the desired cross-sectional dimension to be constructed, and providing a plurality of form panels, with each of the form panels having first and second side edges, top and bottom edges, and a generally planar interconnecting skin. Further, the first side edge of each of the panels is provided with a plurality of attachment holes arranged in a plurality of vertically oriented gage lines, while the skin of each of the panels is provided with a plurality of attachment holes arranged in a plurality of vertically oriented gage lines. A selected one of the gage lines on the first side edge of each panel is secured to a selected one of the gage lines on the skin of an adjacent panel, thereby creating the concrete column form having the desired cross-sectional dimension.

Preferably, the step of providing the plurality of form panels includes the steps of providing a first set of form panels and providing a second set of form panels, with the first set of form panels having a first spacing between the first side edge gage lines and a second spacing between the skin gage lines, and with the second set of form panels having a third spacing between the first side edge gage lines and a fourth spacing between the skin gage lines. The method may further include the steps of selecting a pair of form panels form the first set of form panels, selecting a set of form panels of from the second set of form panels, and placing a form panel from each set between a pair of form panels from the other set.

In accordance with an additional aspect of the invention, a method of constructing a concrete column form having a desired one of a plurality of available cross-sectional dimensions comprises the steps of choosing the desired cross-sectional dimension to be constructed, and providing a plurality of form panels, with each of the form panels having first and second side edges, top and bottom edges, and a generally planar interconnecting skin. A plurality of attachment portions is provided on the first side edge of each of the panels, and a plurality of attachment portions is provided on the skin of each of the panels. A selected one of the first side edge attachment portions of each of the panels is adjustably secured to a selected one of the attachment portions on the skin of an adjacent panel, thereby creating the concrete column form having the desired cross-sectional dimension.

Other features and advantages are inherent in the apparatus claimed and disclosed or will become apparent to those skilled in the art from the following detailed description and its accompanying drawings.

DETAILED DESCRIPTION OF THE INVENTION

The embodiment described herein is not intended to be exhaustive or to limit the scope of the invention to the precise form disclosed. The following embodiment has been chosen and described in order to best explain the principles of the invention and to enable others skilled in the art to follow its teachings.

Figure 1:
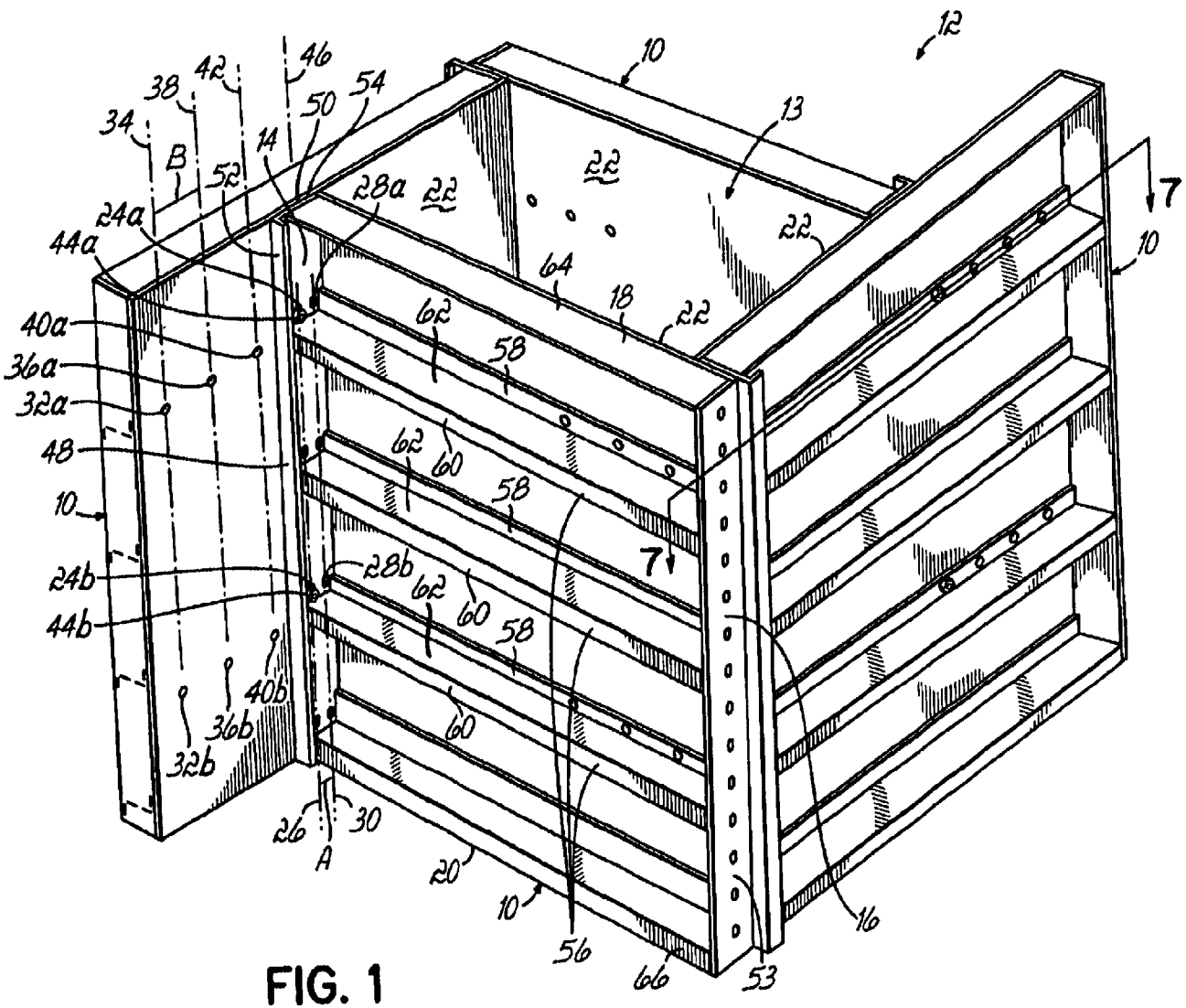
FIG. 1 is a perspective view of a plurality of form panels constructed in accordance with the teachings of the present invention assembled together to form a section of a modular column form for constructing a concrete column.

Referring now to FIG. 1 of the drawings, a plurality of modular form panels constructed in accordance with the teachings of the present invention and which are generally referred to by the reference numeral 10 are shown assembled in adjacent relationship to form a section of a column form 12 for forming a concrete column (not shown) by pouring uncured concrete into a cavity 13 enclosed on four sides by the panels.

Referring now to FIGS. 2, 3, 3A, 4, 5 and 6, a single form panel 10 is shown. Although four such form panels 10 may be assembled to form the column form 12 illustrated in FIG. 1, it will be understood that in the first embodiment of the invention the four form panels 10 are substantially identical, and thus for the sake of brevity only a single form panel 10 will be described hereinafter in detail. The form panel 10 includes a pair of side edges 14, 16, interconnecting top and bottom edges 18, 20, and an interconnecting and generally planar skin 22.

The side edge 14 includes a first set of holes 24 including holes 24*a*, 24*b*, 24*c* and 24*d* arranged along a first vertical gage line 26, and further includes a second set of holes 28 including holes 28*a*, 28*b*, 28*c*, and 28*d* arranged along a second vertical gage line 30. It will be understood that, although four holes are shown in the gage line 26 (24*a*–24*d*) and four holes are shown in the gage line 30 (30*a*–30*d*), more or fewer holes may be used in each of the gage lines 26, 30. Further, additional gage lines (not shown) may be used. It will further be understood that not all of the holes in each of the gage lines 26, 30 need actually be used when assembling the column form 12.

The planar skin 22 includes a first set of holes 32*a* and 32*b*, which are arranged along a vertical gage line 34. The planar skin 22 also includes a second set of holes 36*a* and 36*b*, which are arranged along a second vertical gage line 38. The planar skin 22 further includes a third set of holes 40*a* and 40*b*, which are arranged along a third vertical gage line 42, and finally includes a fourth set of holes 44*a* and 44*b*, which are arranged along a fourth vertical gage line 46. It will be understood that, although two holes are shown in each of the gage lines 34, 38, 42, and 46, more or fewer holes may be used in each of the gage lines, and it will further be understood that the planar skin 22 may have additional gage lines (not shown). It will also be understood that if additional holes are provided in each of the gage lines, that not all of the holes need be used when assembling the column form 12.

Figure 3:
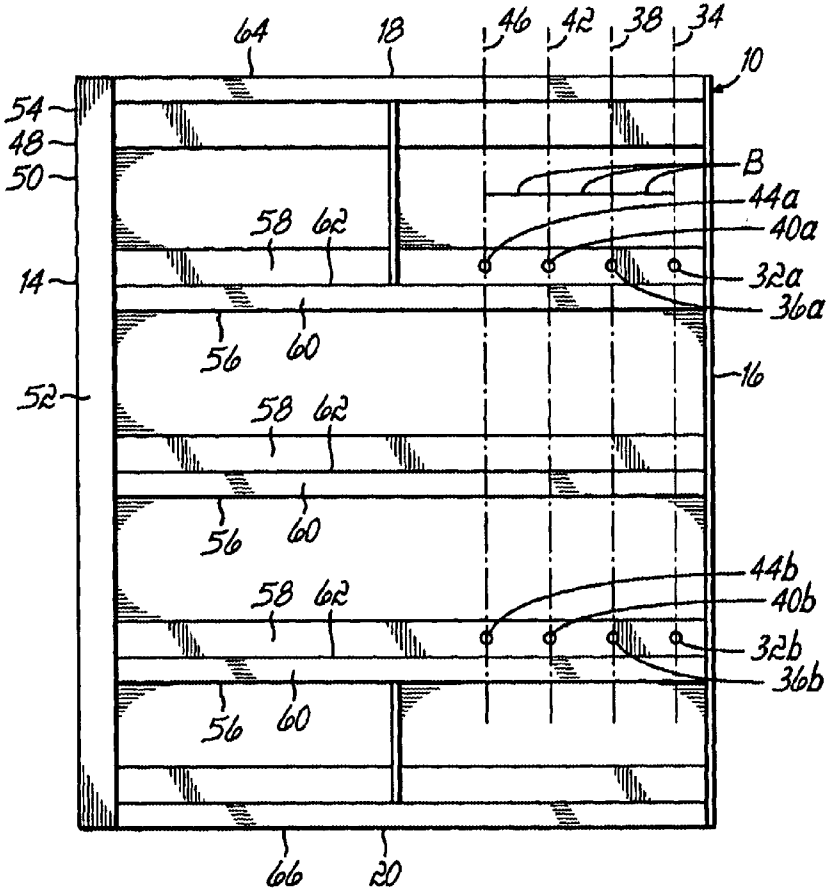
FIG. 3 is an elevational view of a single one of the form panels illustrated in FIG. 1 and showing the back or stiffened side of the form panel (i.e., the side opposite the skin of the panel and which faces away from the column to be formed)
Figure 2:
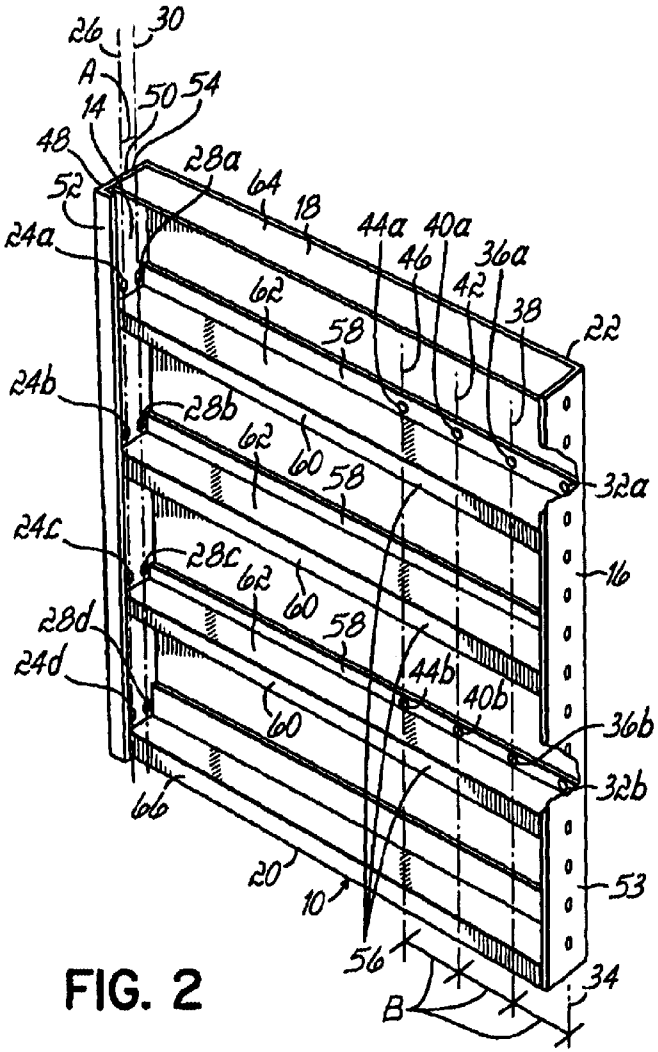
FIG. 2 is a perspective view of a single one of the form panels illustrated in FIG. 1.
Figure 11A:
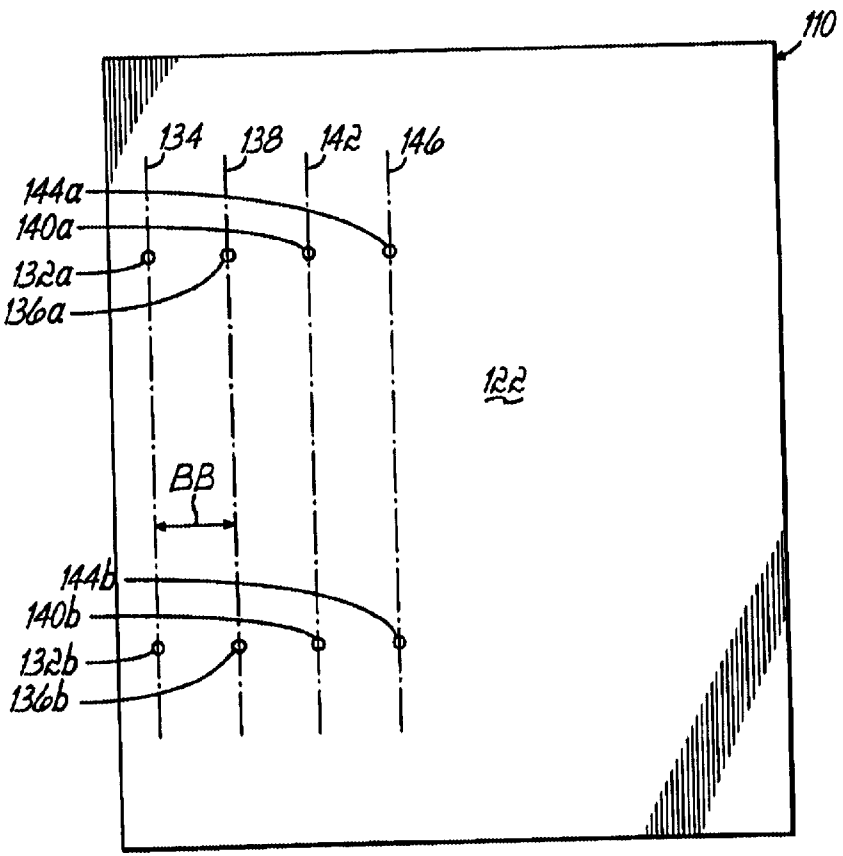
FIG. 11A is an elevational view of the form panel of FIG. 11 taken form the other side illustrating the skin of the panel which faces the concrete to be poured.
Figure 3A:
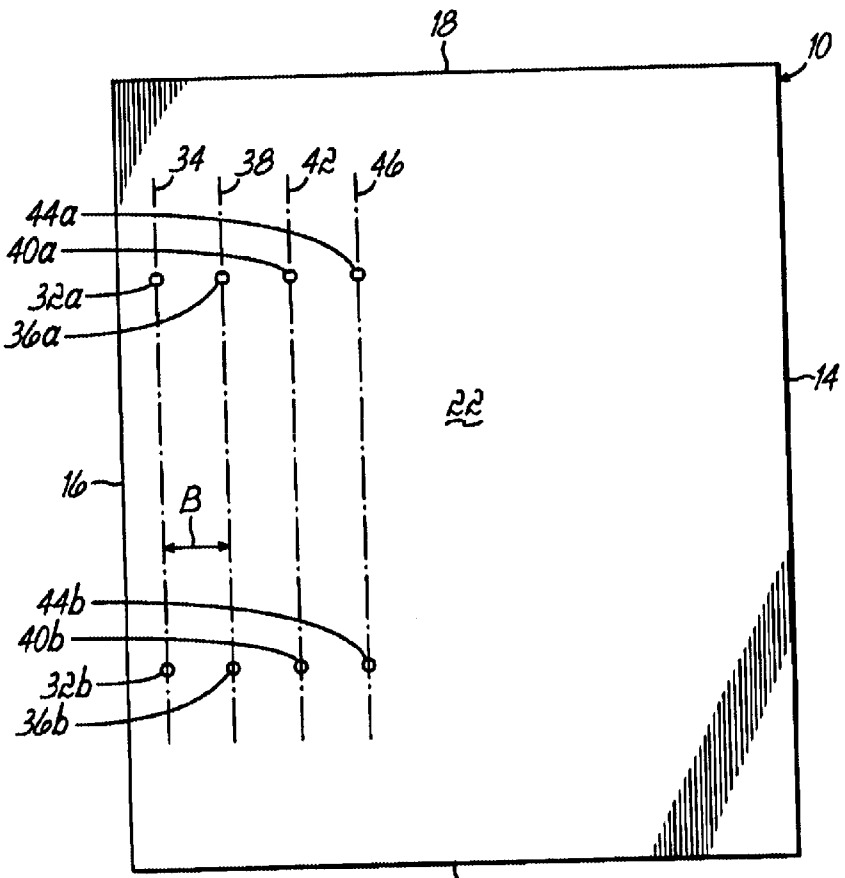
FIG. 3A is an elevational view of the form panel of FIG. 3 taken form the other side illustrating the skin of the panel which faces the concrete to be poured.
Figure 6:
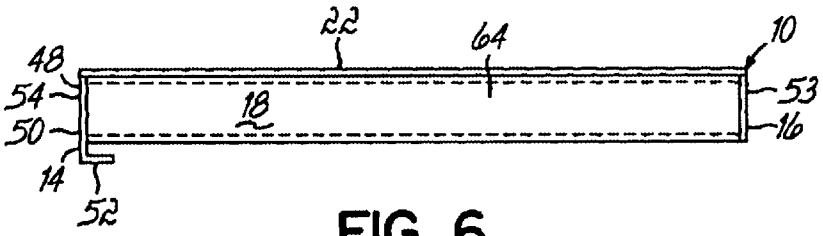
FIG. 6 is a top plan view of the form panel of FIG. 3.
Figure 5:
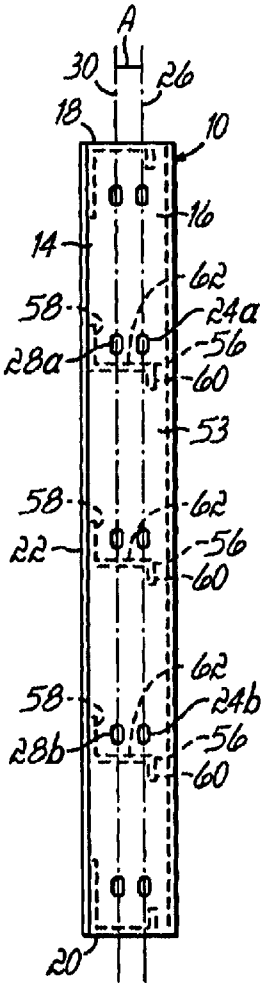
FIG. 5 is a left side elevational view of the form panel of FIG. 3.
Figure 4:
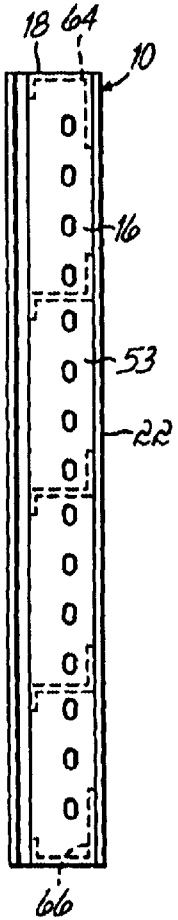
FIG. 4 is a right side elevational view of the form panel of FIG. 3.

Referring now to FIGS. 2, 3 and 6, the side edge 14 may include a stiffener 48. The stiffener 48 includes is a generally L-shaped member having a pair of legs 50, 52. At least a portion, if not all, of the leg 50 will generally define a widened face 54 which will abut the skin 22 of an adjacent and similar panel 10 in the manner to be described in greater detail below. It will be noted that in the preferred embodiment the sets of holes 24, 28 are defined in the leg 50 of the stiffener 48. The side edge 16 may also include a stiffener 53, in which a plurality of holes 54 may be defined for purposes of handling, etc. Alternatively, the stiffener 53 may be constructed so as to have a widened face similar to the stiffener 48 such that two (2) rows of holes 54 may be provided for purposes of permitting the attachment of other elements or components used in the construction process as may be contemplated by those skilled in the art.

It will be noted when viewing either of FIGS. 1, 2, 5 or 6 that the gage lines 26, 30 on the side edge 14 are spaced apart a distance A, while the gage lines 34, 38, 42 and 46 on the skin 22 are spaced apart a distance B. In accordance with a preferred embodiment, the distances A and B are not equal. In further accordance with a preferred embodiment, the distance A is less than B, with the distance A measuring about two (2) inches and the distance,B measuring about four (4) inches. As will be outlined in greater detail below with respect to a second preferred embodiment of the invention, other distances may also be used.

Referring now to FIGS. 1 through 6, the panel 10 may further include one or more lateral or horizontal stiffeners 56. The stiffeners 56 may be formed of a Z-shaped section having a pair of legs 58, 60 and an interconnecting web 62. It will be noted that the leg 58 of the stiffeners are disposed so as to abut the backside of the planar skin (the backside being the face of the skin facing away from the concrete to be poured). The form panels may also include a top stiffener 64 disposed along the top edge 18 and a bottom stiffener 66 disposed along the bottom edge 20. As shown, each of the top and bottom stiffeners are formed of C-shaped members having legs of unequal length. Other stiffeners may be used. It will be understood that the panel 10 may be assembled by welding or by any other suitable attachment means.

Figure 9:
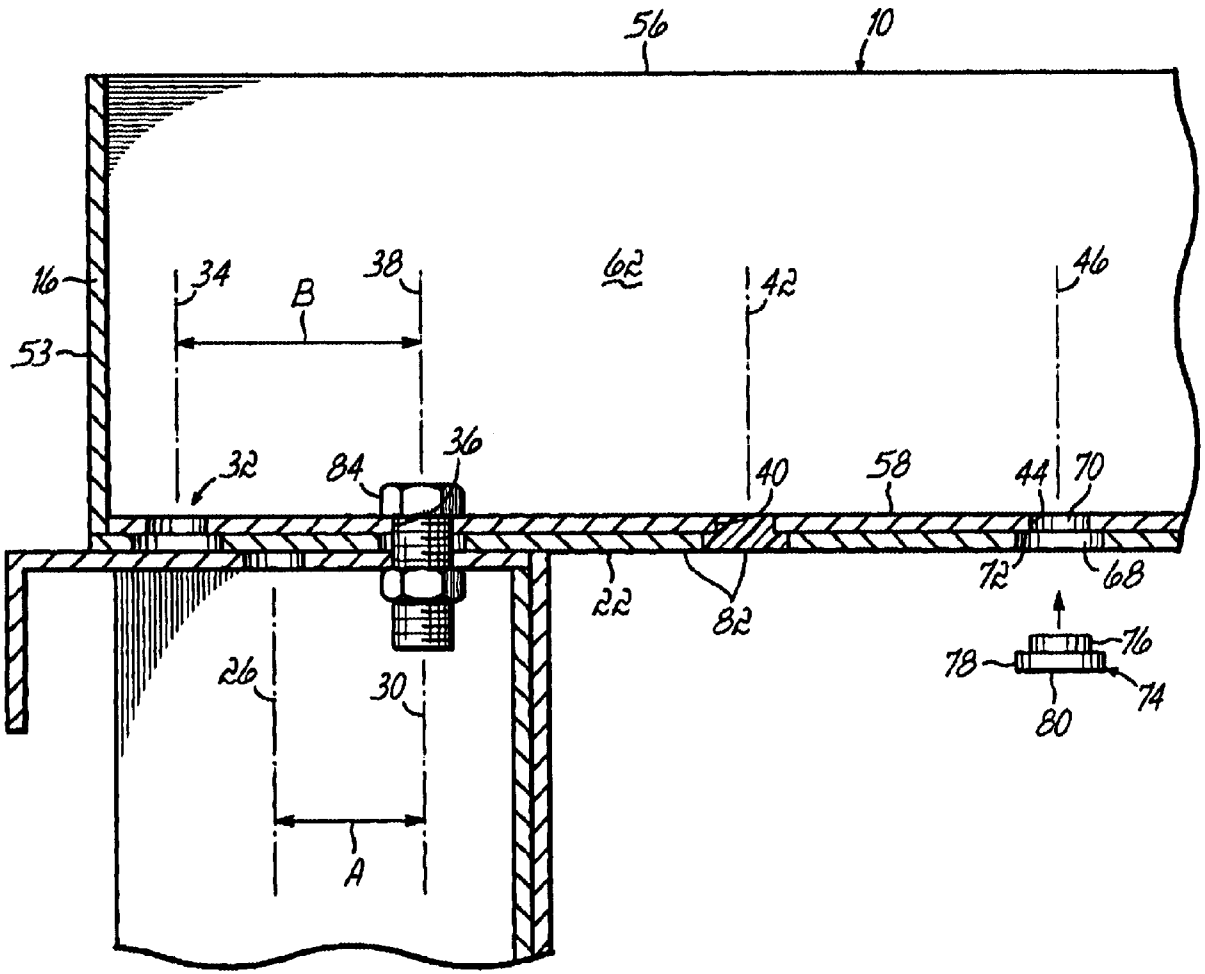
FIG. 9 is an enlarged fragmentary cross-sectional view illustrating an unused attachment hole intersecting one of the Z-shaped stiffeners and further illustrating one of the plugs adapted for placement in the unused hole of the form panel of FIG. 3.
Figure 10C:
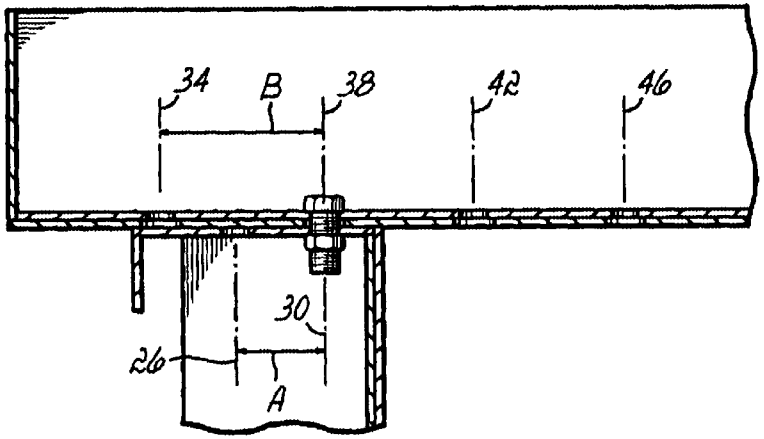
FIGS. 10A through 10H are an enlarged fragmentary top plan views illustrating a variety of possible attachment points between the side edge of one panel and the skin of its adjacent panel and further illustrating the full utilization of both of the gage lines on the side edge of the panel as well as all of the gage lines on the skin of the adjacent panel.
Figure 10D:
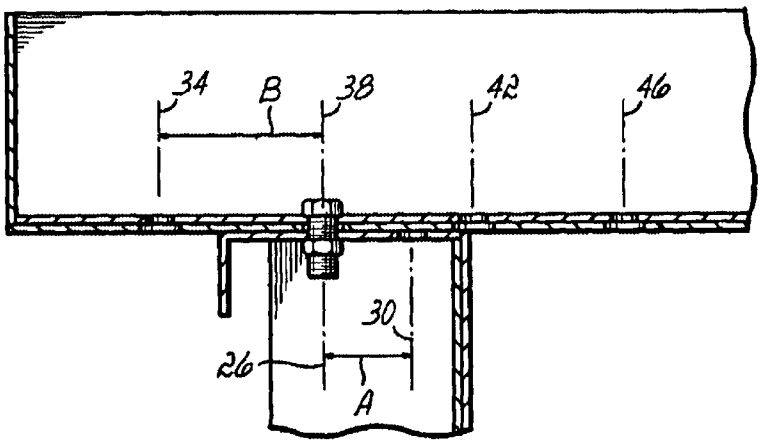
Figure 10A:
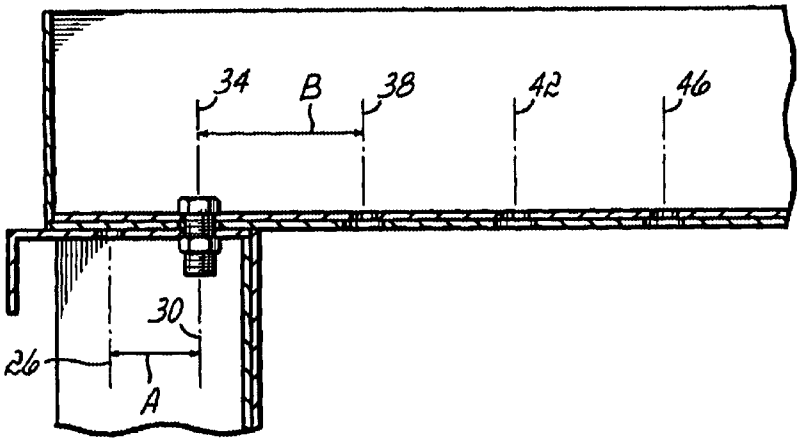
Figure 10B:
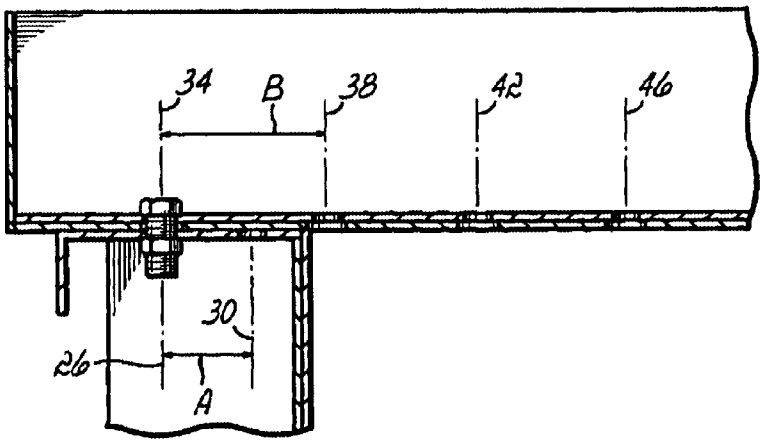
Figure 10G:
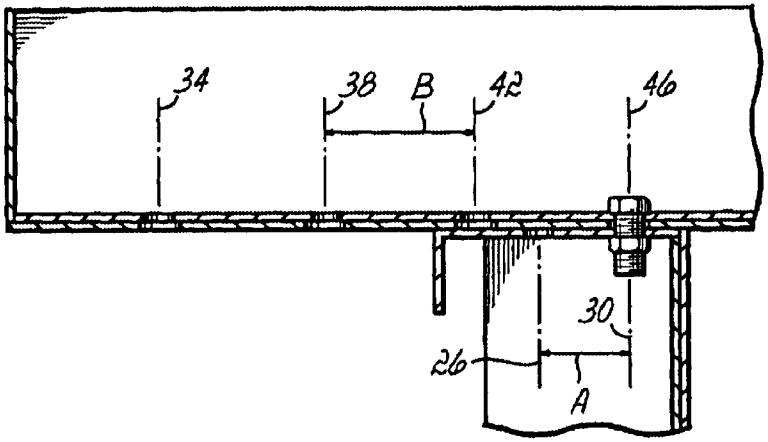
Figure 10H:
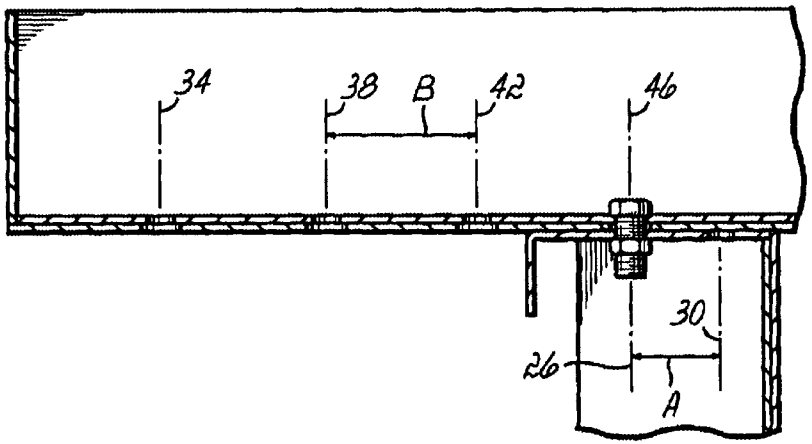
Figure 10E:
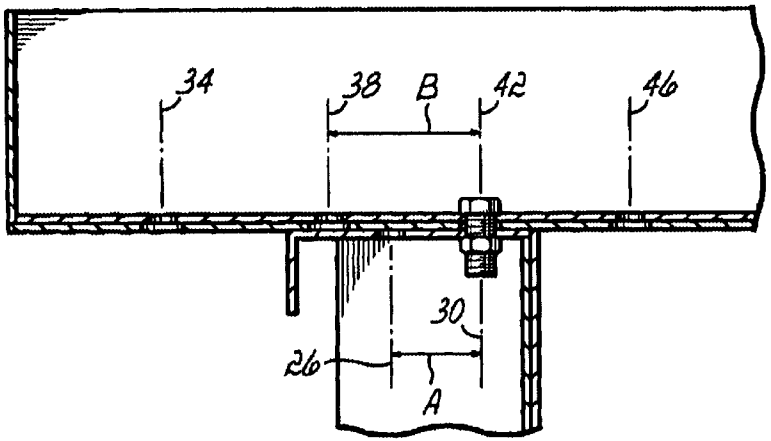
Figure 10F:
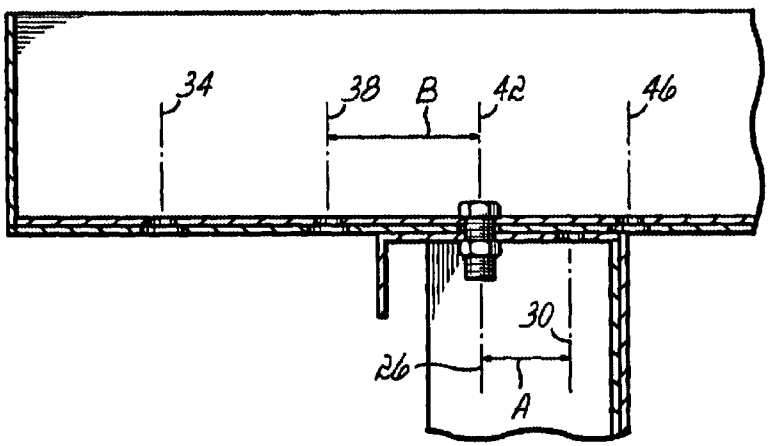
Figure 11:
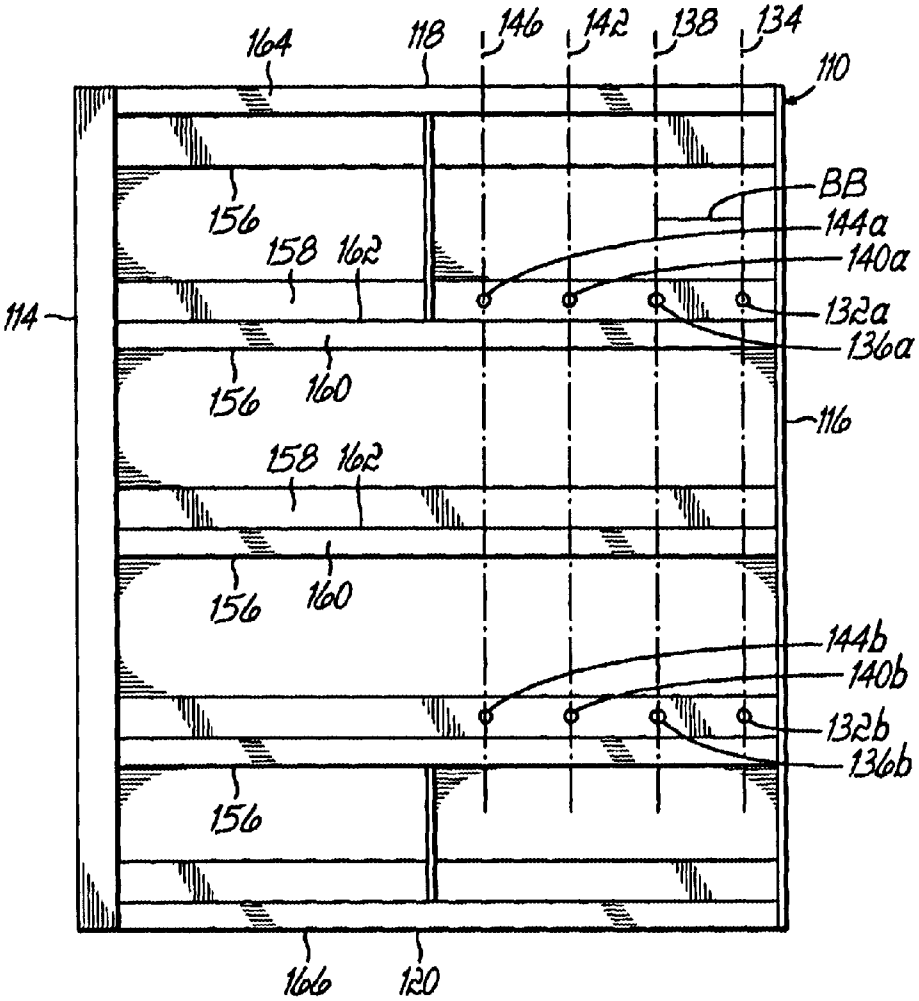
FIG. 11 is an elevational view of a single form panel similar to the panel illustrated in FIGS. 3–6 but illustrating different spacing on the gage lines for the attachment holes on the first side edge and on the skin.
Figure 14:
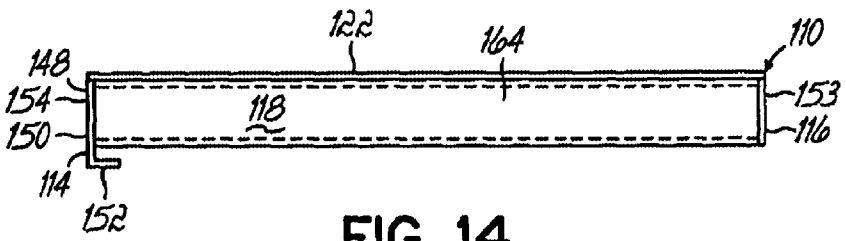
FIG. 14 is a top plan view of the form panel of FIG. 11.
Figure 13:
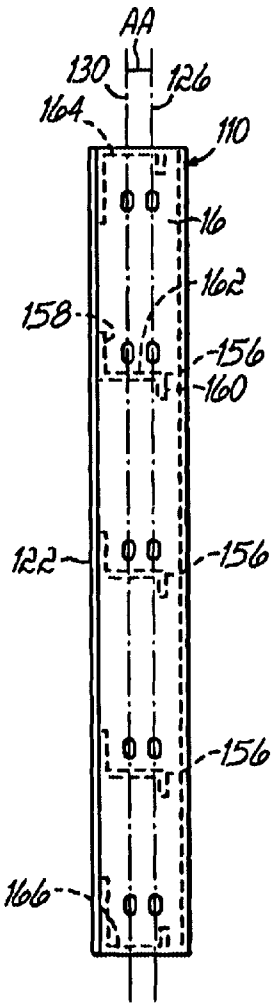
FIG. 13 is a left side elevational view of the form panel of FIG. 11.
Figure 12:
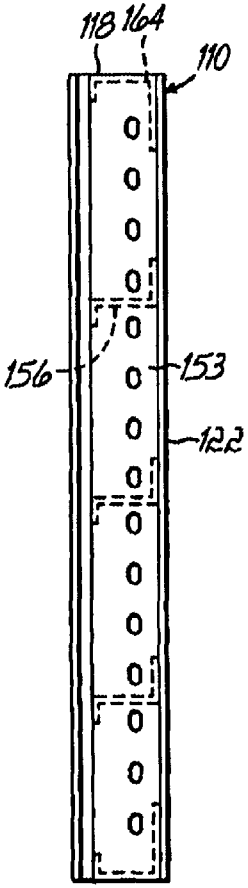
FIG. 12 is a right side elevational view of the form panel of FIG. 11.

Referring now to FIGS. 1 and 9, it will be noted that when the panels 10 shown therein are assembled to form the column form 12, that at least three of the four gage lines in the skin 22 will be unused. When the panels 10 are assembled as shown in FIG. 1, then the second, third and fourth sets of holes (i.e., holes 36*a*, 36*b*, 40*a*, 40*b*, 44*a*, and 44*b*) along the gage lines 38, 42 and 46, respectively, will be exposed to the concrete to be poured into the cavity 13. If left unplugged, at least a portion of the uncured concrete and/or water would seep through the respective holes. Preferably, some means is provided for plugging the respective holes. In the preferred embodiment, and referring specifically to FIG. 9 which illustrates the holes 32*a*, 36*a*, 40*a* and 44*a*, each of the respective holes will include a first portion 68 which extends through the skin 22 and a second portion 70 which extends through the leg 58 of the stiffener 56. It will be noted that the first portion 68 is countersunk (i.e., the first portion 68 has a diameter larger than the diameter of the second portion 70). Consequently, a ledge or annular seat 72 is formed at the interface between the first portion 68 and the second portion 70.

Also shown in FIG. 9 is a plug 74 having a shank 76 sized to fit into the second portion 70. The plug 74 also includes a head 78 having a planar end surface 80. The head 78 is sized to fit into the first portion 68, such that the head is seated on the annular seat 72. Accordingly, the end surface 80 cooperates with the surface of the skin 22 to form a generally continuous and uninterrupted planar surface 82 facing into the cavity 13. It will be understood that the planar surface 82 will improve the surface characteristics of the concrete column formed in the cavity 13 due to the fact that no portion of the plug 74 will extend past the skin 22.

Figure 7:
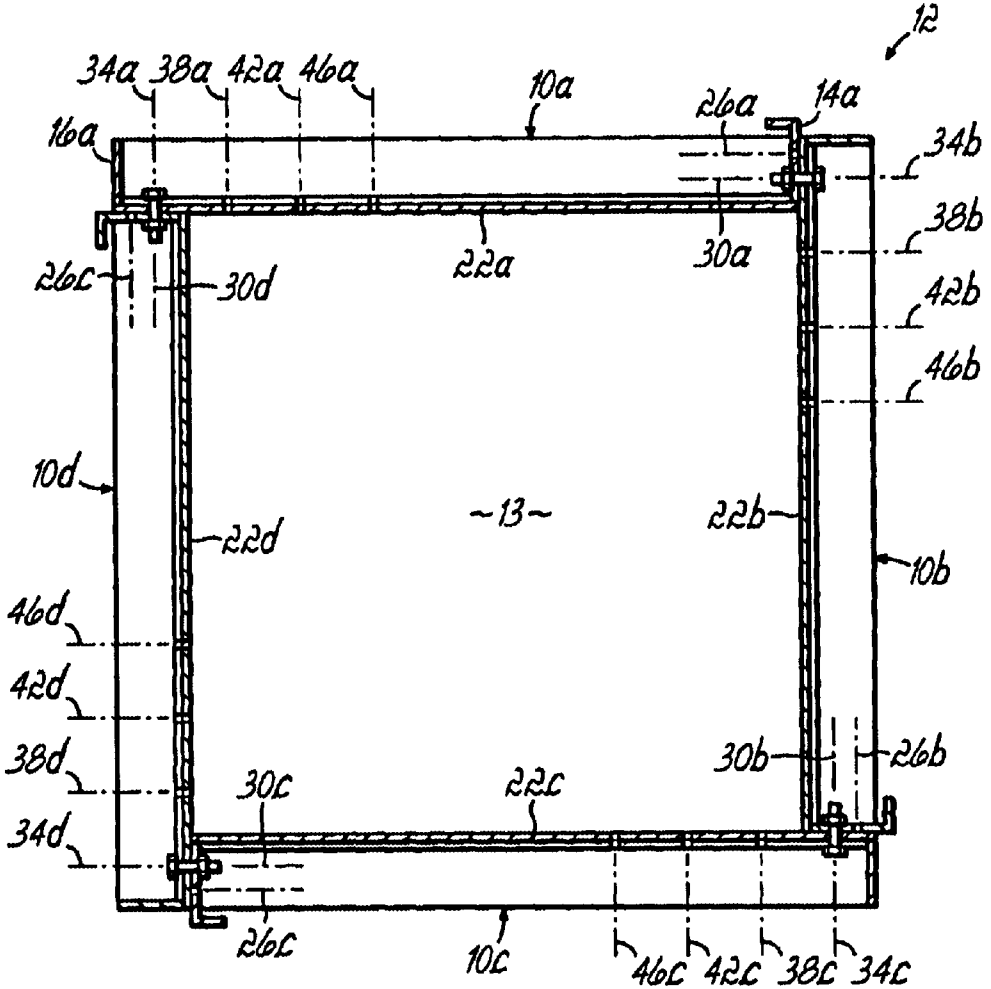
FIG. 7 is a cross-sectional view of the assembled column form illustrated in FIG. 1 and taken generally at the level of the line 7—7 thereof showing the column form assembled in a generally square arrangement.

In operation, four of the panels 10 (hereinafter labeled panels 10*a*, 10*b*, 10*c* and 10*d* for clarity) are placed as shown in FIGS. 1 and 7. It will again be understood that each of the panels 10 shown in FIGS. 1 and 7 are substantially identical. When so assembled, the side edge 14*a* of the first panel 10*a* will be disposed adjacent the skin 22*b* of the adjacent panel 10*b*, and so on (i.e., the side edge 14*b* of panel 10*b* will be disposed adjacent the skin 22*c* of the adjacent panel 10*c*, the side edge 14*c* of the panel 10*c* will be disposed adjacent the skin 22*d* of the adjacent panel 10*d*, and the side edge 14*d* of the panel 10*d* will be disposed adjacent the skin 22*a* of the adjacent panel 10*a*). Using a plurality of bolts 84 (which may be any suitable fastener of the type commonly employed in the assembly of forms), the panels 10*a*–10*d* may be secured to each other in a variety of configurations so as to define a cavity 13 having any one of a desired number of available cross-sectional dimensions. Note that, in a preferred embodiment, the panel skin may have a thickness of about 3⁄16 of an inch, and the stiffeners may have a thickness of about 3⁄16 to about ¼ of an inch.

When configured as shown in FIG. 7, the gage line 30*a* on the side edge 14*a* of the panel 10*a* is secured to the skin 22*b* of the panel 10*b* along the gage line 34*b*. Similarly, the gage line 30*b* on the side edge 14*b* of the panel 10*b* is secured to the skin 22*c* of the panel 10*c* along the gage line 34*c*. Similarly, the gage line 30*c* on the side edge 14*c* of the panel 10*c* is secured to the skin 22*d* of the panel 10*d* along the gage line 34*d*. Finally, the gage line 30*d* of the panel 10*d* is secured to the skin 22*a* of the panel 10*a* along the gage line 34*a*.

Figure 8:
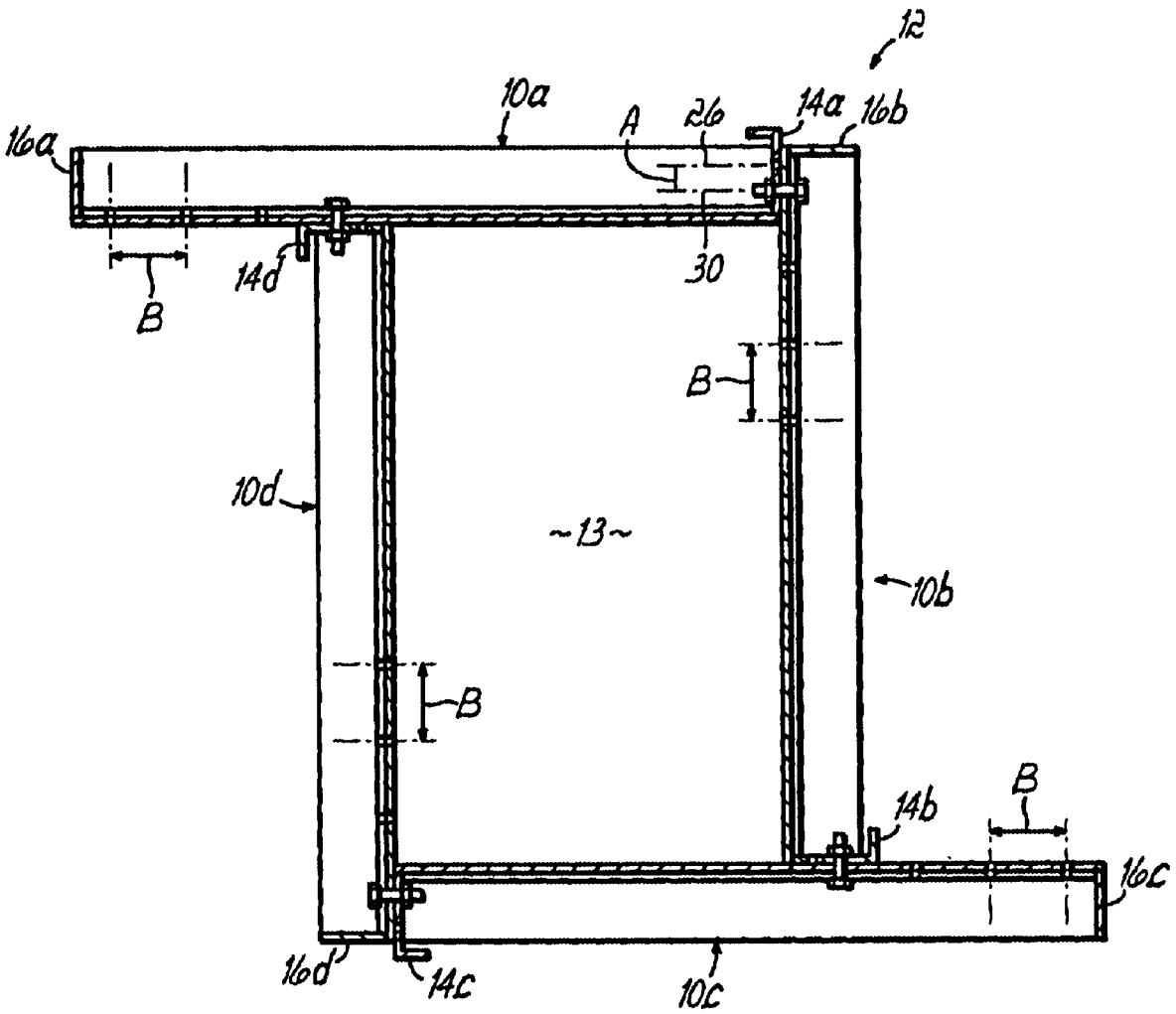
FIG. 8 is a cross-sectional view of an assembled column form similar to FIG. 7 but showing the column form assembled in a generally rectangular arrangement.

Referring now to FIGS. 10*a*–10*h*, it will be understood that the cross-sectional dimensions of the cavity 13 can be varied widely simply by selecting a desired cross-section for the cavity 13, and then choosing which gage lines 26, 30 shall be used on the side edge 14 of the panels 10, and which gage lines 34, 38, 42 and 46 shall be used on the skin 22 of the next adjacent panel. As would be evident to those skilled in the art, a variety of square cross-sectional configurations may be achieved, with a representative example of a square cross-sectional configuration being shown in FIG. 7. As would further be evident to those of skill in the art, a variety of rectangular cross-sectional configurations may be achieved as well, with a representative rectangular cross-sectional configuration being shown in FIG. 8.

It will be understood that a plurality of like panels 10 assembled into a column form 12 may be placed on top of the column form 12 shown in FIG. 1, such that a column of various vertical dimensions may be formed.

Figure 8A:
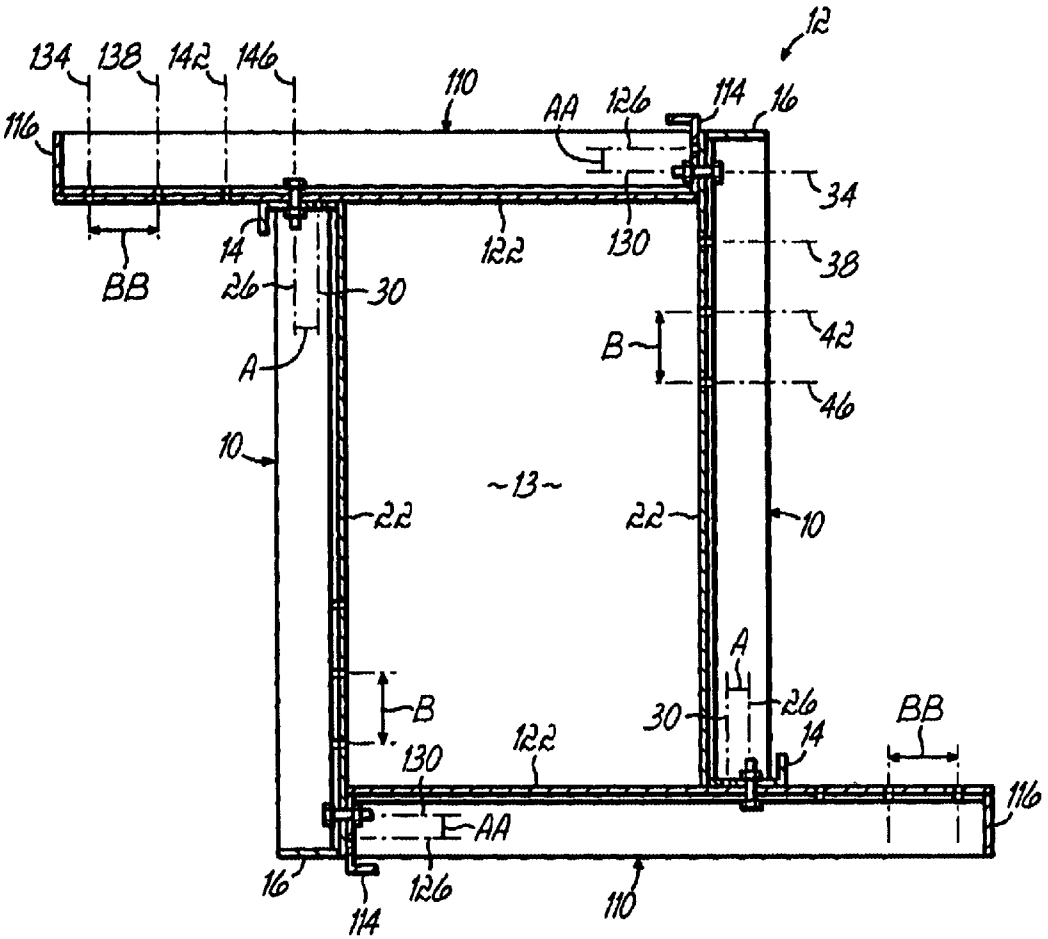
FIG. 8A is a cross-sectional view similar to FIG. 8 but illustrating the form panels assembled in a generally rectangular arrangement in which two civil panels are used and two commercial panels are used.

Referring now to FIGS. 11–14, a form panel assembled in accordance with an alternate embodiment of the invention is shown and is referred to by the reference numeral 110. The panel 110 is in many respects similar to the panel 10 described above, and therefore all like elements will have the same reference numeral, albeit increased by an increment of 100. Four (4) of the panels 110 may be used in conjunction with each other, or alternatively the panels 110 may be used as shown in FIG. 8*a*, with a pair of the panels 110 being disposed between a pair of the panels 10 in alternating fashion. The form panel 110 includes a pair of side edges 114, 116, interconnecting top and bottom edges 118, 120, and an interconnecting and generally planar skin 122. The side edge 114 includes first and second sets of holes 124, 128 arranged along a pair of vertical gage lines 126, 130. The planar skin 122 includes a plurality of holes arranged along four vertical gage lines 134, 138, 142, and 146. Each of the panels 110 may be provided with a plurality of Z-shaped stiffeners 156 as well as top, bottom and side stiffeners 164, 166, and 153, respectively.

It will be noted that the gage lines 126, 130 on the side edge 114 are spaced apart a distance AA, while the gage lines 134, 138, 142 and 146 on the skin 122 are spaced apart a distance BB. Again, the distances AA and BB need not be equal, and preferably are unequal. In the alternate embodiment, the distance AA is less than BB, with the distance AA measuring about three (3) inches and the distance BB measuring about six (6) inches. The panel 110 is preferably substantially similar to the panel 10 in all other respects.

It will be noted that the panels 10 may generally be referred to as "Commercial" panels, while the panels 110 may generally be referred to as "Civil" panels. Each of the Commercial and civil panels may be assembled in a variety of nominal widths ranging from about, for example, twenty four inches to about, for example, forty eight inches. The panels 10, 110 will typically have vertical dimensions of about forty eight inches, and as outlined above can be stacked to form columns of varying vertical dimensions. The column form 12 assembled using the panels will exhibit a very high acceptable pour pressure, exceeding 2000 psf.

Referring now to Tables A through L, Table A illustrates eight different groupings of possible form assembly arrangements, with the groupings shown therein being labeled as Groups I through VIII. For example, Group I illustrates the cross-sectional dimensions achievable when bolting a nominal twenty four inch (24") commercial panel 10 to a like panel, using any one of the possible gage line combinations illustrated in the corresponding FIGS. 10A through 10H. Group II illustrates the possible cross-sectional dimensions achievable when bolting a nominal twenty four inch (24") civil panel 110 to a twenty four inch (24") commercial panel 10.

Group III illustrates the cross-sectional dimensions achievable when bolting a nominal thirty six inch (36") commercial panel 10 to a like panel, using any one of the possible gage line combinations illustrated in the corresponding FIGS. 10A through 10H, while Group IV illustrates the possible cross-sectional dimensions achievable when bolting a nominal thirty six inch (36") civil panel 110 to a thirty six inch (36") commercial panel 10.

Group V illustrates the cross-sectional dimensions achievable when bolting a nominal thirty six inch (36") civil panel 110 to a like panel, using any one of the possible gage line combinations illustrated in the corresponding FIG. 10A through 10H, while Group VI illustrates the possible cross-sectional dimensions achievable when bolting a nominal thirty six inch (36") commercial panel 10 to a thirty six inch (36") civil panel 110.

Finally, Group VII illustrates the cross-sectional dimensions achievable when bolting a nominal forty eight inch (48") civil panel 110 to a like panel, using any one of the possible gage line combinations illustrated in the corresponding FIGS. 10A through 10H, while Group VIII illustrates the possible cross-sectional dimensions achievable when bolting a nominal forty eight inch (48") commercial panel 10 to a forty eight inch (48") civil panel 110. Each of the resulting cross-sections shown in Table A are generally square.

As would be known to those of skill in the art, the conventional size adjustment increments of civil form panels are generally referred to in terms of three inch (3") increments, while the conventional size adjustment increments of commercial form panels are generally referred to in terms of two inch (2") increments. It is of course understood that other size increments may be desired in some applications.

Tables B through K illustrate a number of possible form assembly arrangements, including possible rectangular arrangements. The tabular arrangements are again achieved by selecting which of the gage lines are used on the four panels employed, and by varying the panels chosen (i.e., four civil panels, four commercial panels, or alternating two panels from one type with two panels of another type). Again, the sizes are achieved by selecting which of the gage lines will be employed as shown in FIGS. 10A through 10H.

Finally, Table L illustrates the number of different form dimensions available using the listed panel combinations, it being understood that there may be some duplication of form sizes.

TABLE A

| | COLUMN FORM SYSTEM BOLT UP POSSIBILITIES | | | | | | | |
|---|---|---|---|---|---|---|---|---|
| SELECTED LINE ON SKIN 22 | 34 | 34 | 38 | 38 | 42 | 42 | 46 | 46 |
| SELECTED LINE ON EDGE 14 | 30 | 26 | 30 | 26 | 30 | 26 | 30 | 26 |
| | FIRST GAUGE | SECOND GAUGE | FIRST GAUGE | SECOND GAUGE | FIRST GAUGE | SECOND GAUGE | FIRST GAUGE | SECOND GAUGE |
| I. 24" COMMERCIAL | 24 | 22 | 20 | 18 | 16 | 14 | 12 | 10 |
| II. CIVIL BOLTED TO 24" COMMERCIAL | 24 | 21 | 20 | 17 | 16 | 13 | 12 | 9 |
| III. 36" COMMERCIAL | 36 | 34 | 32 | 30 | 28 | 26 | 24 | 22 |
| IV. CIVIL BOLTED TO 36" COMMERCIAL | 36 | 33 | 32 | 29 | 28 | 25 | 24 | 21 |
| V. 36" CIVIL | 36 | 33 | 30 | 27 | 24 | 21 | 18 | 15 |
| VI. COMMERCIAL BOLTED TO 36" COMMERCIAL | 36 | 34 | 30 | 28 | 24 | 22 | 18 | 16 |
| VII. 48" CIVIL | 48 | 45 | 42 | 39 | 36 | 33 | 30 | 27 |
| VIII. COMMERCIAL BOLTED TO 48" CIVIL | 48 | 46 | 42 | 40 | 36 | 34 | 30 | 28 |
| CORRESPONDING FIGURE | 10A | 10B | 10C | 10D | 10E | 10F | 10G | 10H |

TABLE B

| | | | |
|---|---|---|---|
| 24" COMM. + 24" COMM. | 24 | X | 24 |
| 24" COMM. + 24" COMM. | 24 | X | 22 |
| 24" COMM. + 24" COMM. | 24 | X | 20 |
| 24" COMM. + 24" COMM. | 24 | X | 18 |
| 24" COMM. + 24" COMM. | 24 | X | 16 |
| 24" COMM. + 24" COMM. | 24 | X | 14 |
| 24" COMM. + 24" COMM. | 24 | X | 12 |
| 24" COMM. + 24" COMM. | 24 | X | 10 |
| 24" COMM. + 24" COMM. | 22 | X | 22 |
| 24" COMM. + 24" COMM. | 22 | X | 20 |
| 24" COMM. + 24" COMM. | 22 | X | 18 |
| 24" COMM. + 24" COMM. | 22 | X | 16 |
| 24" COMM. + 24" COMM. | 22 | X | 14 |
| 24" COMM. + 24" COMM. | 22 | X | 12 |
| 24" COMM. + 24" COMM. | 22 | X | 10 |
| 24" COMM. + 24" COMM. | 20 | X | 20 |
| 24" COMM. + 24" COMM. | 20 | X | 18 |
| 24" COMM. + 24" COMM. | 20 | X | 16 |
| 24" COMM. + 24" COMM. | 20 | X | 14 |
| 24" COMM. + 24" COMM. | 20 | X | 12 |
| 24" COMM. + 24" COMM. | 20 | X | 10 |
| 24" COMM. + 24" COMM. | 18 | X | 18 |
| 24" COMM. + 24" COMM. | 18 | X | 16 |
| 24" COMM. + 24" COMM. | 18 | X | 14 |
| 24" COMM. + 24" COMM. | 18 | X | 12 |
| 24" COMM. + 24" COMM. | 18 | X | 10 |
| 24" COMM. + 24" COMM. | 16 | X | 16 |
| 24" COMM. + 24" COMM. | 16 | X | 14 |
| 24" COMM. + 24" COMM. | 16 | X | 12 |
| 24" COMM. + 24" COMM. | 16 | X | 10 |
| 24" COMM. + 24" COMM. | 14 | X | 14 |
| 24" COMM. + 24" COMM. | 14 | X | 12 |
| 24" COMM. + 24" COMM. | 14 | X | 10 |
| 24" COMM. + 24" COMM. | 12 | X | 12 |
| 24" COMM. + 24" COMM. | 12 | X | 10 |
| 24" COMM. + 24" COMM. | 10 | X | 10 |

TABLE C

| | | | |
|---|---|---|---|
| 36" CIVIL + 36" CIVIL | 36 | X | 36 |
| 36" CIVIL + 36" CIVIL | 36 | X | 33 |
| 36" CIVIL + 36" CIVIL | 36 | X | 30 |
| 36" CIVIL + 36" CIVIL | 36 | X | 27 |
| 36" CIVIL + 36" CIVIL | 36 | X | 24 |
| 36" CIVIL + 36" CIVIL | 36 | X | 21 |
| 36" CIVIL + 36" CIVIL | 36 | X | 18 |
| 36" CIVIL + 36" CIVIL | 36 | X | 15 |
| 36" CIVIL + 36" CIVIL | 33 | X | 33 |
| 36" CIVIL + 36" CIVIL | 33 | X | 30 |
| 36" CIVIL + 36" CIVIL | 33 | X | 27 |

TABLE C-continued

| | | | |
|---|---|---|---|
| 36" CIVIL + 36" CIVIL | 33 | X | 24 |
| 36" CIVIL + 36" CIVIL | 33 | X | 21 |
| 36" CIVIL + 36" CIVIL | 33 | X | 18 |
| 36" CIVIL + 36" CIVIL | 33 | X | 15 |
| 36" CIVIL + 36" CIVIL | 30 | X | 30 |
| 36" CIVIL + 36" CIVIL | 30 | X | 27 |
| 36" CIVIL + 36" CIVIL | 30 | X | 24 |
| 36" CIVIL + 36" CIVIL | 30 | X | 21 |
| 36" CIVIL + 36" CIVIL | 30 | X | 18 |
| 36" CIVIL + 36" CIVIL | 30 | X | 15 |
| 36" CIVIL + 36" CIVIL | 27 | X | 27 |
| 36" CIVIL + 36" CIVIL | 27 | X | 24 |
| 36" CIVIL + 36" CIVIL | 27 | X | 21 |
| 36" CIVIL + 36" CIVIL | 27 | X | 18 |
| 36" CIVIL + 36" CIVIL | 27 | X | 15 |
| 36" CIVIL + 36" CIVIL | 24 | X | 24 |
| 36" CIVIL + 36" CIVIL | 24 | X | 21 |
| 36" CIVIL + 36" CIVIL | 24 | X | 18 |
| 36" CIVIL + 36" CIVIL | 24 | X | 15 |
| 36" CIVIL + 36" CIVIL | 21 | X | 21 |
| 36" CIVIL + 36" CIVIL | 21 | X | 18 |
| 36" CIVIL + 36" CIVIL | 21 | X | 15 |
| 36" CIVIL + 36" CIVIL | 18 | X | 18 |
| 36" CIVIL + 36" CIVIL | 18 | X | 15 |
| 36" CIVIL + 36" CIVIL | 15 | X | 15 |

TABLE D

| | | | |
|---|---|---|---|
| 36" COMM. + 36" COMM. | 36 | X | 36 |
| 36" COMM. + 36" COMM. | 36 | X | 34 |
| 36" COMM. + 36" COMM. | 36 | X | 32 |
| 36" COMM. + 36" COMM. | 36 | X | 30 |
| 36" COMM. + 36" COMM. | 36 | X | 28 |
| 36" COMM. + 36" COMM. | 36 | X | 26 |
| 36" COMM. + 36" COMM. | 36 | X | 24 |
| 36" COMM. + 36" COMM. | 36 | X | 22 |
| 36" COMM. + 36" COMM. | 34 | X | 34 |
| 36" COMM. + 36" COMM. | 34 | X | 32 |
| 36" COMM. + 36" COMM. | 34 | X | 30 |
| 36" COMM. + 36" COMM. | 34 | X | 28 |
| 36" COMM. + 36" COMM. | 34 | X | 26 |
| 36" COMM. + 36" COMM. | 34 | X | 24 |
| 36" COMM. + 36" COMM. | 34 | X | 22 |
| 36" COMM. + 36" COMM. | 32 | X | 32 |
| 36" COMM. + 36" COMM. | 32 | X | 30 |
| 36" COMM. + 36" COMM. | 32 | X | 28 |
| 36" COMM. + 36" COMM. | 32 | X | 26 |
| 36" COMM. + 36" COMM. | 32 | X | 24 |
| 36" COMM. + 36" COMM. | 32 | X | 22 |
| 36" COMM. + 36" COMM. | 30 | X | 30 |

TABLE D-continued

| | | | |
|---|---|---|---|
| 36" COMM. + 36" COMM. | 30 | X | 28 |
| 36" COMM. + 36" COMM. | 30 | X | 26 |
| 36" COMM. + 36" COMM. | 30 | X | 24 |
| 36" COMM. + 36" COMM. | 30 | X | 22 |
| 36" COMM. + 36" COMM. | 28 | X | 28 |
| 36" COMM. + 36" COMM. | 28 | X | 26 |
| 36" COMM. + 36" COMM. | 28 | X | 24 |
| 36" COMM. + 36" COMM. | 28 | X | 22 |
| 36" COMM. + 36" COMM. | 26 | X | 26 |
| 36" COMM. + 36" COMM. | 26 | X | 24 |
| 36" COMM. + 36" COMM. | 26 | X | 22 |
| 36" COMM. + 36" COMM. | 24 | X | 24 |
| 36" COMM. + 36" COMM. | 24 | X | 22 |
| 36" COMM. + 36" COMM. | 22 | X | 22 |

TABLE E

| | | | |
|---|---|---|---|
| 48" CIVIL + 48" CIVIL | 48 | X | 48 |
| 48" CIVIL + 48" CIVIL | 48 | X | 45 |
| 48" CIVIL + 48" CIVIL | 48 | X | 42 |
| 48" CIVIL + 48" CIVIL | 48 | X | 39 |
| 48" CIVIL + 48" CIVIL | 48 | X | 36 |
| 48" CIVIL + 48" CIVIL | 48 | X | 33 |
| 48" CIVIL + 48" CIVIL | 48 | X | 30 |
| 48" CIVIL + 48" CIVIL | 48 | X | 27 |
| 48" CIVIL + 48" CIVIL | 45 | X | 45 |
| 48" CIVIL + 48" CIVIL | 45 | X | 42 |
| 48" CIVIL + 48" CIVIL | 45 | X | 39 |
| 48" CIVIL + 48" CIVIL | 45 | X | 36 |
| 48" CIVIL + 48" CIVIL | 45 | X | 33 |
| 48" CIVIL + 48" CIVIL | 45 | X | 30 |
| 48" CIVIL + 48" CIVIL | 45 | X | 27 |
| 48" CIVIL + 48" CIVIL | 42 | X | 42 |
| 48" CIVIL + 48" CIVIL | 42 | X | 39 |
| 48" CIVIL + 48" CIVIL | 42 | X | 36 |
| 48" CIVIL + 48" CIVIL | 42 | X | 33 |
| 48" CIVIL + 48" CIVIL | 42 | X | 30 |
| 48" CIVIL + 48" CIVIL | 42 | X | 27 |
| 48" CIVIL + 48" CIVIL | 39 | X | 39 |
| 48" CIVIL + 48" CIVIL | 39 | X | 36 |
| 48" CIVIL + 48" CIVIL | 39 | X | 33 |
| 48" CIVIL + 48" CIVIL | 39 | X | 30 |
| 48" CIVIL + 48" CIVIL | 39 | X | 27 |
| 48" CIVIL + 48" CIVIL | 36 | X | 36 |
| 48" CIVIL + 48" CIVIL | 36 | X | 33 |
| 48" CIVIL + 48" CIVIL | 36 | X | 30 |
| 48" CIVIL + 48" CIVIL | 36 | X | 27 |
| 48" CIVIL + 48" CIVIL | 33 | X | 33 |
| 48" CIVIL + 48" CIVIL | 33 | X | 30 |
| 48" CIVIL + 48" CIVIL | 33 | X | 27 |
| 48" CIVIL + 48" CIVIL | 30 | X | 30 |
| 48" CIVIL + 48" CIVIL | 30 | X | 27 |
| 48" CIVIL + 48" CIVIL | 27 | X | 27 |

TABLE F

| | | | |
|---|---|---|---|
| 36" COMM. + 24 " COMM. | 36 | X | 24 |
| 36" COMM. + 24 " COMM. | 36 | X | 22 |
| 36" COMM. + 24 " COMM. | 36 | X | 20 |
| 36" COMM. + 24 " COMM. | 36 | X | 18 |
| 36" COMM. + 24 " COMM. | 36 | X | 16 |
| 36" COMM. + 24 " COMM. | 36 | X | 14 |
| 36" COMM. + 24 " COMM. | 36 | X | 12 |
| 36" COMM. + 24 " COMM. | 36 | X | 10 |
| 36" COMM. + 24 " COMM. | 34 | X | 24 |
| 36" COMM. + 24 " COMM. | 34 | X | 22 |
| 36" COMM. + 24 " COMM. | 34 | X | 20 |
| 36" COMM. + 24 " COMM. | 34 | X | 18 |
| 36" COMM. + 24 " COMM. | 34 | X | 16 |
| 36" COMM. + 24 " COMM. | 34 | X | 14 |
| 36" COMM. + 24 " COMM. | 34 | X | 12 |
| 36" COMM. + 24 " COMM. | 34 | X | 10 |
| 36" COMM. + 24 " COMM. | 32 | X | 24 |
| 36" COMM. + 24 " COMM. | 32 | X | 22 |

TABLE F-continued

| | | | |
|---|---|---|---|
| 36" COMM. + 24 " COMM. | 32 | X | 20 |
| 36" COMM. + 24 " COMM. | 32 | X | 18 |
| 36" COMM. + 24 " COMM. | 32 | X | 16 |
| 36" COMM. + 24 " COMM. | 32 | X | 14 |
| 36" COMM. + 24 " COMM. | 32 | X | 12 |
| 36" COMM. + 24 " COMM. | 32 | X | 10 |
| 36" COMM. + 24 " COMM. | 30 | X | 24 |
| 36" COMM. + 24 " COMM. | 30 | X | 22 |
| 36" COMM. + 24 " COMM. | 30 | X | 20 |
| 36" COMM. + 24 " COMM. | 30 | X | 18 |
| 36" COMM. + 24 " COMM. | 30 | X | 16 |
| 36" COMM. + 24 " COMM. | 30 | X | 14 |
| 36" COMM. + 24 " COMM. | 30 | X | 12 |
| 36" COMM. + 24 " COMM. | 30 | X | 10 |
| 36" COMM. + 24 " COMM. | 28 | X | 24 |
| 36" COMM. + 24 " COMM. | 28 | X | 22 |
| 36" COMM. + 24 " COMM. | 28 | X | 20 |
| 36" COMM. + 24 " COMM. | 28 | X | 18 |
| 36" COMM. + 24 " COMM. | 28 | X | 16 |
| 36" COMM. + 24 " COMM. | 28 | X | 14 |
| 36" COMM. + 24 " COMM. | 28 | X | 12 |
| 36" COMM. + 24 " COMM. | 28 | X | 10 |
| 36" COMM. + 24 " COMM. | 26 | X | 24 |
| 36" COMM. + 24 " COMM. | 26 | X | 22 |
| 36" COMM. + 24 " COMM. | 26 | X | 20 |
| 36" COMM. + 24 " COMM. | 26 | X | 18 |
| 36" COMM. + 24 " COMM. | 26 | X | 16 |
| 36" COMM. + 24 " COMM. | 26 | X | 14 |
| 36" COMM. + 24 " COMM. | 26 | X | 12 |
| 36" COMM. + 24 " COMM. | 26 | X | 10 |
| 36" COMM. + 24 " COMM. | 24 | X | 24 |
| 36" COMM. + 24 " COMM. | 24 | X | 22 |
| 36" COMM. + 24 " COMM. | 24 | X | 20 |
| 36" COMM. + 24 " COMM. | 24 | X | 18 |
| 36" COMM. + 24 " COMM. | 24 | X | 16 |
| 36" COMM. + 24 " COMM. | 24 | X | 14 |
| 36" COMM. + 24 " COMM. | 24 | X | 12 |
| 36" COMM. + 24 " COMM. | 24 | X | 10 |
| 36" COMM. + 24 " COMM. | 22 | X | 22 |
| 36" COMM. + 24 " COMM. | 22 | X | 20 |
| 36" COMM. + 24 " COMM. | 22 | X | 18 |
| 36" COMM. + 24 " COMM. | 22 | X | 16 |
| 36" COMM. + 24 " COMM. | 22 | X | 14 |
| 36" COMM. + 24 " COMM. | 22 | X | 12 |
| 36" COMM. + 24 " COMM. | 22 | X | 10 |

TABLE G

| | | | |
|---|---|---|---|
| 48" CIVIL + 36" CIVIL | 48 | X | 36 |
| 48" CIVIL + 36" CIVIL | 48 | X | 33 |
| 48" CIVIL + 36" CIVIL | 48 | X | 30 |
| 48" CIVIL + 36" CIVIL | 48 | X | 27 |
| 48" CIVIL + 36" CIVIL | 48 | X | 24 |
| 48" CIVIL + 36" CIVIL | 48 | X | 21 |
| 48" CIVIL + 36" CIVIL | 48 | X | 18 |
| 48" CIVIL + 36" CIVIL | 48 | X | 15 |
| 48" CIVIL + 36" CIVIL | 45 | X | 36 |
| 48" CIVIL + 36" CIVIL | 45 | X | 33 |
| 48" CIVIL + 36" CIVIL | 45 | X | 30 |
| 48" CIVIL + 36" CIVIL | 45 | X | 27 |
| 48" CIVIL + 36" CIVIL | 45 | X | 24 |
| 48" CIVIL + 36" CIVIL | 45 | X | 21 |
| 48" CIVIL + 36" CIVIL | 45 | X | 18 |
| 48" CIVIL + 36" CIVIL | 45 | X | 15 |
| 48" CIVIL + 36" CIVIL | 42 | X | 36 |
| 48" CIVIL + 36" CIVIL | 42 | X | 33 |
| 48" CIVIL + 36" CIVIL | 42 | X | 30 |
| 48" CIVIL + 36" CIVIL | 42 | X | 27 |
| 48" CIVIL + 36" CIVIL | 42 | X | 24 |
| 48" CIVIL + 36" CIVIL | 42 | X | 21 |
| 48" CIVIL + 36" CIVIL | 42 | X | 18 |
| 48" CIVIL + 36" CIVIL | 42 | X | 15 |
| 48" CIVIL + 36" CIVIL | 39 | X | 36 |
| 48" CIVIL + 36" CIVIL | 39 | X | 33 |
| 48" CIVIL + 36" CIVIL | 39 | X | 30 |
| 48" CIVIL + 36" CIVIL | 39 | X | 27 |

TABLE G-continued

| | | | |
|---|---|---|---|
| 48" CIVIL + 36" CIVIL | 39 | X | 24 |
| 48" CIVIL + 36" CIVIL | 39 | X | 21 |
| 48" CIVIL + 36" CIVIL | 39 | X | 18 |
| 48" CIVIL + 36" CIVIL | 39 | X | 15 |
| 48" CIVIL + 36" CIVIL | 36 | X | 36 |
| 48" CIVIL + 36" CIVIL | 36 | X | 33 |
| 48" CIVIL + 36" CIVIL | 36 | X | 30 |
| 48" CIVIL + 36" CIVIL | 36 | X | 27 |
| 48" CIVIL + 36" CIVIL | 36 | X | 24 |
| 48" CIVIL + 36" CIVIL | 36 | X | 21 |
| 48" CIVIL + 36" CIVIL | 36 | X | 18 |
| 48" CIVIL + 36" CIVIL | 36 | X | 15 |
| 48" CIVIL + 36" CIVIL | 33 | X | 33 |
| 48" CIVIL + 36" CIVIL | 33 | X | 30 |
| 48" CIVIL + 36" CIVIL | 33 | X | 27 |
| 48" CIVIL + 36" CIVIL | 33 | X | 24 |
| 48" CIVIL + 36" CIVIL | 33 | X | 21 |
| 48" CIVIL + 36" CIVIL | 33 | X | 18 |
| 48" CIVIL + 36" CIVIL | 33 | X | 15 |
| 48" CIVIL + 36" CIVIL | 30 | X | 30 |
| 48" CIVIL + 36" CIVIL | 30 | X | 27 |
| 48" CIVIL + 36" CIVIL | 30 | X | 24 |
| 48" CIVIL + 36" CIVIL | 30 | X | 21 |
| 48" CIVIL + 36" CIVIL | 30 | X | 18 |
| 48" CIVIL + 36" CIVIL | 30 | X | 15 |
| 48" CIVIL + 36" CIVIL | 27 | X | 27 |
| 48" CIVIL + 36" CIVIL | 27 | X | 24 |
| 48" CIVIL + 36" CIVIL | 27 | X | 21 |
| 48" CIVIL + 36" CIVIL | 27 | X | 18 |
| 48" CIVIL + 36" CIVIL | 27 | X | 15 |

TABLE H

| | | | |
|---|---|---|---|
| 36" CIVIL + 24 " COMM. | 36 | X | 24 |
| 36" CIVIL + 24 " COMM. | 36 | X | 21 |
| 36" CIVIL + 24 " COMM. | 36 | X | 20 |
| 36" CIVIL + 24 " COMM. | 36 | X | 17 |
| 36" CIVIL + 24 " COMM. | 36 | X | 16 |
| 36" CIVIL + 24 " COMM. | 36 | X | 13 |
| 36" CIVIL + 24 " COMM. | 36 | X | 12 |
| 36" CIVIL + 24 " COMM. | 36 | X | 9 |
| 36" CIVIL + 24 " COMM. | 34 | X | 24 |
| 36" CIVIL + 24 " COMM. | 34 | X | 21 |
| 36" CIVIL + 24 " COMM. | 34 | X | 20 |
| 36" CIVIL + 24 " COMM. | 34 | X | 17 |
| 36" CIVIL + 24 " COMM. | 34 | X | 16 |
| 36" CIVIL + 24 " COMM. | 34 | X | 13 |
| 36" CIVIL + 24 " COMM. | 34 | X | 12 |
| 36" CIVIL + 24 " COMM. | 34 | X | 9 |
| 36" CIVIL + 24 " COMM. | 30 | X | 24 |
| 36" CIVIL + 24 " COMM. | 30 | X | 21 |
| 36" CIVIL + 24 " COMM. | 30 | X | 20 |
| 36" CIVIL + 24 " COMM. | 30 | X | 17 |
| 36" CIVIL + 24 " COMM. | 30 | X | 16 |
| 36" CIVIL + 24 " COMM. | 30 | X | 13 |
| 36" CIVIL + 24 " COMM. | 30 | X | 12 |
| 36" CIVIL + 24 " COMM. | 30 | X | 9 |
| 36" CIVIL + 24 " COMM. | 28 | X | 24 |
| 36" CIVIL + 24 " COMM. | 28 | X | 21 |
| 36" CIVIL + 24 " COMM. | 28 | X | 20 |
| 36" CIVIL + 24 " COMM. | 28 | X | 17 |
| 36" CIVIL + 24 " COMM. | 28 | X | 16 |
| 36" CIVIL + 24 " COMM. | 28 | X | 13 |
| 36" CIVIL + 24 " COMM. | 28 | X | 12 |
| 36" CIVIL + 24 " COMM. | 28 | X | 9 |
| 36" CIVIL + 24 " COMM. | 24 | X | 24 |
| 36" CIVIL + 24 " COMM. | 24 | X | 21 |
| 36" CIVIL + 24 " COMM. | 24 | X | 20 |
| 36" CIVIL + 24 " COMM. | 24 | X | 17 |
| 36" CIVIL + 24 " COMM. | 24 | X | 16 |
| 36" CIVIL + 24 " COMM. | 24 | X | 13 |
| 36" CIVIL + 24 " COMM. | 24 | X | 12 |
| 36" CIVIL + 24 " COMM. | 24 | X | 9 |
| 36" CIVIL + 24 " COMM. | 22 | X | 24 |
| 36" CIVIL + 24 " COMM. | 22 | X | 21 |
| 36" CIVIL + 24 " COMM. | 22 | X | 20 |

TABLE H-continued

| | | | |
|---|---|---|---|
| 36" CIVIL + 24 " COMM. | 22 | X | 17 |
| 36" CIVIL + 24 " COMM. | 22 | X | 16 |
| 36" CIVIL + 24 " COMM. | 22 | X | 13 |
| 36" CIVIL + 24 " COMM. | 22 | X | 12 |
| 36" CIVIL + 24 " COMM. | 22 | X | 9 |
| 36" CIVIL + 24 " COMM. | 18 | X | 24 |
| 36" CIVIL + 24 " COMM. | 18 | X | 21 |
| 36" CIVIL + 24 " COMM. | 18 | X | 20 |
| 36" CIVIL + 24 " COMM. | 18 | X | 17 |
| 36" CIVIL + 24 " COMM. | 18 | X | 16 |
| 36" CIVIL + 24 " COMM. | 18 | X | 13 |
| 36" CIVIL + 24 " COMM. | 18 | X | 12 |
| 36" CIVIL + 24 " COMM. | 18 | X | 9 |
| 36" CIVIL + 24 " COMM. | 16 | X | 24 |
| 36" CIVIL + 24 " COMM. | 16 | X | 21 |
| 36" CIVIL + 24 " COMM. | 16 | X | 20 |
| 36" CIVIL + 24 " COMM. | 16 | X | 17 |
| 36" CIVIL + 24 " COMM. | 16 | X | 16 |
| 36" CIVIL + 24 " COMM. | 16 | X | 13 |
| 36" CIVIL + 24 " COMM. | 16 | X | 12 |
| 36" CIVIL + 24 " COMM. | 16 | X | 9 |

TABLE I

| | | | |
|---|---|---|---|
| 48" CIVIL + 24" COMM. | 48 | X | 24 |
| 48" CIVIL + 24" COMM. | 48 | X | 21 |
| 48" CIVIL + 24" COMM. | 48 | X | 20 |
| 48" CIVIL + 24" COMM. | 48 | X | 17 |
| 48" CIVIL + 24" COMM. | 48 | X | 16 |
| 48" CIVIL + 24" COMM. | 48 | X | 13 |
| 48" CIVIL + 24" COMM. | 48 | X | 12 |
| 48" CIVIL + 24" COMM. | 48 | X | 9 |
| 48" CIVIL + 24" COMM. | 46 | X | 24 |
| 48" CIVIL + 24" COMM. | 46 | X | 21 |
| 48" CIVIL + 24" COMM. | 46 | X | 20 |
| 48" CIVIL + 24" COMM. | 46 | X | 17 |
| 48" CIVIL + 24" COMM. | 46 | X | 16 |
| 48" CIVIL + 24" COMM. | 46 | X | 13 |
| 48" CIVIL + 24" COMM. | 46 | X | 12 |
| 48" CIVIL + 24" COMM. | 46 | X | 9 |
| 48" CIVIL + 24" COMM. | 42 | X | 24 |
| 48" CIVIL + 24" COMM. | 42 | X | 21 |
| 48" CIVIL + 24" COMM. | 42 | X | 20 |
| 48" CIVIL + 24" COMM. | 42 | X | 17 |
| 48" CIVIL + 24" COMM. | 42 | X | 16 |
| 48" CIVIL + 24" COMM. | 42 | X | 13 |
| 48" CIVIL + 24" COMM. | 42 | X | 12 |
| 48" CIVIL + 24" COMM. | 42 | X | 9 |
| 48" CIVIL + 24" COMM. | 40 | X | 24 |
| 48" CIVIL + 24" COMM. | 40 | X | 21 |
| 48" CIVIL + 24" COMM. | 40 | X | 20 |
| 48" CIVIL + 24" COMM. | 40 | X | 17 |
| 48" CIVIL + 24" COMM. | 40 | X | 16 |
| 48" CIVIL + 24" COMM. | 40 | X | 13 |
| 48" CIVIL + 24" COMM. | 40 | X | 12 |
| 48" CIVIL + 24" COMM. | 40 | X | 9 |
| 48" CIVIL + 24" COMM. | 36 | X | 24 |
| 48" CIVIL + 24" COMM. | 36 | X | 21 |
| 48" CIVIL + 24" COMM. | 36 | X | 20 |
| 48" CIVIL + 24" COMM. | 36 | X | 17 |
| 48" CIVIL + 24" COMM. | 36 | X | 16 |
| 48" CIVIL + 24" COMM. | 36 | X | 13 |
| 48" CIVIL + 24" COMM. | 36 | X | 12 |
| 48" CIVIL + 24" COMM. | 36 | X | 9 |
| 48" CIVIL + 24" COMM. | 34 | X | 24 |
| 48" CIVIL + 24" COMM. | 34 | X | 21 |
| 48" CIVIL + 24" COMM. | 34 | X | 20 |
| 48" CIVIL + 24" COMM. | 34 | X | 17 |
| 48" CIVIL + 24" COMM. | 34 | X | 16 |
| 48" CIVIL + 24" COMM. | 34 | X | 13 |
| 48" CIVIL + 24" COMM. | 34 | X | 12 |
| 48" CIVIL + 24" COMM. | 34 | X | 9 |
| 48" CIVIL + 24" COMM. | 30 | X | 24 |
| 48" CIVIL + 24" COMM. | 30 | X | 21 |
| 48" CIVIL + 24" COMM. | 30 | X | 20 |
| 48" CIVIL + 24" COMM. | 30 | X | 17 |

TABLE I-continued

| | | | |
|---|---|---|---|
| 48" CIVIL + 24" COMM. | 30 | X | 16 |
| 48" CIVIL + 24" COMM. | 30 | X | 13 |
| 48" CIVIL + 24" COMM. | 30 | X | 12 |
| 48" CIVIL + 24" COMM. | 30 | X | 9 |
| 48" CIVIL + 24" COMM. | 28 | X | 24 |
| 48" CIVIL + 24" COMM. | 28 | X | 21 |
| 48" CIVIL + 24" COMM. | 28 | X | 20 |
| 48" CIVIL + 24" COMM. | 28 | X | 17 |
| 48" CIVIL + 24" COMM. | 28 | X | 16 |
| 48" CIVIL + 24" COMM. | 28 | X | 13 |
| 48" CIVIL + 24" COMM. | 28 | X | 12 |
| 48" CIVIL + 24" COMM. | 28 | X | 9 |

TABLE J

| | | | |
|---|---|---|---|
| 36" CIVIL + 36" COMM. | 36 | X | 36 |
| 36" CIVIL + 36" COMM. | 36 | X | 33 |
| 36" CIVIL + 36" COMM. | 36 | X | 32 |
| 36" CIVIL + 36" COMM. | 36 | X | 29 |
| 36" CIVIL + 36" COMM. | 36 | X | 28 |
| 36" CIVIL + 36" COMM. | 36 | X | 25 |
| 36" CIVIL + 36" COMM. | 36 | X | 24 |
| 36" CIVIL + 36" COMM. | 36 | X | 21 |
| 36" CIVIL + 36" COMM. | 34 | X | 36 |
| 36" CIVIL + 36" COMM. | 34 | X | 33 |
| 36" CIVIL + 36" COMM. | 34 | X | 32 |
| 36" CIVIL + 36" COMM. | 34 | X | 29 |
| 36" CIVIL + 36" COMM. | 34 | X | 28 |
| 36" CIVIL + 36" COMM. | 34 | X | 25 |
| 36" CIVIL + 36" COMM. | 34 | X | 24 |
| 36" CIVIL + 36" COMM. | 34 | X | 21 |
| 36" CIVIL + 36" COMM. | 30 | X | 36 |
| 36" CIVIL + 36" COMM. | 30 | X | 33 |
| 36" CIVIL + 36" COMM. | 30 | X | 32 |
| 36" CIVIL + 36" COMM. | 30 | X | 29 |
| 36" CIVIL + 36" COMM. | 30 | X | 28 |
| 36" CIVIL + 36" COMM. | 30 | X | 25 |
| 36" CIVIL + 36" COMM. | 30 | X | 24 |
| 36" CIVIL + 36" COMM. | 30 | X | 21 |
| 36" CIVIL + 36" COMM. | 28 | X | 36 |
| 36" CIVIL + 36" COMM. | 28 | X | 33 |
| 36" CIVIL + 36" COMM. | 28 | X | 32 |
| 36" CIVIL + 36" COMM. | 28 | X | 29 |
| 36" CIVIL + 36" COMM. | 28 | X | 28 |
| 36" CIVIL + 36" COMM. | 28 | X | 25 |
| 36" CIVIL + 36" COMM. | 28 | X | 24 |
| 36" CIVIL + 36" COMM. | 28 | X | 21 |
| 36" CIVIL + 36" COMM. | 24 | X | 36 |
| 36" CIVIL + 36" COMM. | 24 | X | 33 |
| 36" CIVIL + 36" COMM. | 24 | X | 32 |
| 36" CIVIL + 36" COMM. | 24 | X | 29 |
| 36" CIVIL + 36" COMM. | 24 | X | 28 |
| 36" CIVIL + 36" COMM. | 24 | X | 25 |
| 36" CIVIL + 36" COMM. | 24 | X | 24 |
| 36" CIVIL + 36" COMM. | 24 | X | 21 |
| 36" CIVIL + 36" COMM. | 22 | X | 36 |
| 36" CIVIL + 36" COMM. | 22 | X | 33 |
| 36" CIVIL + 36" COMM. | 22 | X | 32 |
| 36" CIVIL + 36" COMM. | 22 | X | 29 |
| 36" CIVIL + 36" COMM. | 22 | X | 28 |
| 36" CIVIL + 36" COMM. | 22 | X | 25 |
| 36" CIVIL + 36" COMM. | 22 | X | 24 |
| 36" CIVIL + 36" COMM. | 22 | X | 21 |
| 36" CIVIL + 36" COMM. | 18 | X | 36 |
| 36" CIVIL + 36" COMM. | 18 | X | 33 |
| 36" CIVIL + 36" COMM. | 18 | X | 32 |
| 36" CIVIL + 36" COMM. | 18 | X | 29 |
| 36" CIVIL + 36" COMM. | 18 | X | 28 |
| 36" CIVIL + 36" COMM. | 18 | X | 25 |
| 36" CIVIL + 36" COMM. | 18 | X | 24 |
| 36" CIVIL + 36" COMM. | 18 | X | 21 |
| 36" CIVIL + 36" COMM. | 16 | X | 36 |
| 36" CIVIL + 36" COMM. | 16 | X | 33 |
| 36" CIVIL + 36" COMM. | 16 | X | 32 |
| 36" CIVIL + 36" COMM. | 16 | X | 29 |
| 36" CIVIL + 36" COMM. | 16 | X | 28 |

TABLE J-continued

| | | | |
|---|---|---|---|
| 36" CIVIL + 36" COMM. | 16 | X | 25 |
| 36" CIVIL + 36" COMM. | 16 | X | 24 |
| 36" CIVIL + 36" COMM. | 16 | X | 21 |

TABLE K

| | | | |
|---|---|---|---|
| 48" CIVIL + 36" COMM. | 48 | X | 36 |
| 48" CIVIL + 36" COMM. | 48 | X | 33 |
| 48" CIVIL + 36" COMM. | 48 | X | 32 |
| 48" CIVIL + 36" COMM. | 48 | X | 29 |
| 48" CIVIL + 36" COMM. | 48 | X | 28 |
| 48" CIVIL + 36" COMM. | 48 | X | 25 |
| 48" CIVIL + 36" COMM. | 48 | X | 24 |
| 48" CIVIL + 36" COMM. | 48 | X | 21 |
| 48" CIVIL + 36" COMM. | 48 | X | 36 |
| 48" CIVIL + 36" COMM. | 46 | X | 33 |
| 48" CIVIL + 36" COMM. | 46 | X | 32 |
| 48" CIVIL + 36" COMM. | 46 | X | 29 |
| 48" CIVIL + 36" COMM. | 46 | X | 28 |
| 48" CIVIL + 36" COMM. | 46 | X | 25 |
| 48" CIVIL + 36" COMM. | 46 | X | 24 |
| 48" CIVIL + 36" COMM. | 46 | X | 21 |
| 48" CIVIL + 36" COMM. | 42 | X | 36 |
| 48" CIVIL + 36" COMM. | 42 | X | 33 |
| 48" CIVIL + 36" COMM. | 42 | X | 32 |
| 48" CIVIL + 36" COMM. | 42 | X | 29 |
| 48" CIVIL + 36" COMM. | 42 | X | 28 |
| 48" CIVIL + 36" COMM. | 42 | X | 25 |
| 48" CIVIL + 36" COMM. | 42 | X | 24 |
| 48" CIVIL + 36" COMM. | 42 | X | 21 |
| 48" CIVIL + 36" COMM. | 40 | X | 36 |
| 48" CIVIL + 36" COMM. | 40 | X | 33 |
| 48" CIVIL + 36" COMM. | 40 | X | 32 |
| 48" CIVIL + 36" COMM. | 40 | X | 29 |
| 48" CIVIL + 36" COMM. | 40 | X | 28 |
| 48" CIVIL + 36" COMM. | 40 | X | 25 |
| 48" CIVIL + 36" COMM. | 40 | X | 24 |
| 48" CIVIL + 36" COMM. | 40 | X | 21 |
| 48" CIVIL + 36" COMM. | 36 | X | 36 |
| 48" CIVIL + 36" COMM. | 36 | X | 33 |
| 48" CIVIL + 36" COMM. | 36 | X | 32 |
| 48" CIVIL + 36" COMM. | 36 | X | 29 |
| 48" CIVIL + 36" COMM. | 36 | X | 28 |
| 48" CIVIL + 36" COMM. | 36 | X | 25 |
| 48" CIVIL + 36" COMM. | 36 | X | 24 |
| 48" CIVIL + 36" COMM. | 36 | X | 21 |
| 48" CIVIL + 36" COMM. | 34 | X | 36 |
| 48" CIVIL + 36" COMM. | 34 | X | 33 |
| 48" CIVIL + 36" COMM. | 34 | X | 32 |
| 48" CIVIL + 36" COMM. | 34 | X | 29 |
| 48" CIVIL + 36" COMM. | 34 | X | 28 |
| 48" CIVIL + 36" COMM. | 34 | X | 25 |
| 48" CIVIL + 36" COMM. | 34 | X | 24 |
| 48" CIVIL + 36" COMM. | 34 | X | 21 |
| 48" CIVIL + 36" COMM. | 30 | X | 36 |
| 48" CIVIL + 36" COMM. | 30 | X | 33 |
| 48" CIVIL + 36" COMM. | 30 | X | 32 |
| 48" CIVIL + 36" COMM. | 30 | X | 29 |
| 48" CIVIL + 36" COMM. | 30 | X | 28 |
| 48" CIVIL + 36" COMM. | 30 | X | 25 |
| 48" CIVIL + 36" COMM. | 30 | X | 24 |
| 48" CIVIL + 36" COMM. | 30 | X | 21 |
| 48" CIVIL + 36" COMM. | 28 | X | 36 |
| 48" CIVIL + 36" COMM. | 28 | X | 33 |
| 48" CIVIL + 36" COMM. | 28 | X | 32 |
| 48" CIVIL + 36" COMM. | 28 | X | 29 |
| 48" CIVIL + 36" COMM. | 28 | X | 28 |
| 48" CIVIL + 36" COMM. | 28 | X | 25 |
| 48" CIVIL + 36" COMM. | 28 | X | 24 |
| 48" CIVIL + 36" COMM. | 28 | X | 21 |

TABLE L

| CONFIG-URATION | SIZE POSSIBILITIES | CONFIG-URATION | SIZE POSSIBILITIES |
|---|---|---|---|
| 24" COMM. + 24" COMM. | 36 | 36" CIVIL + 36" CIVIL | 36 |
| 36" COMM. + 36" COMM. | 36 | 48" CIVIL + 48" CIVIL | 36 |
| 36" COMM. + 24" COMM. | 63 | 48" CIVIL + 36" CIVIL | 58 |
| 36" CIVIL + 24" COMM. | 64 | 48" CIVIL + 24" COMM. | 64 |
| 36" CIVIL + 36" COMM. | 64 | 48" CIVIL + 36" COMM. | 64 |

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed:

1. A system for constructing a concrete column form, the system comprising:

a plurality of identical form panels, each of the form panels comprising:

a first side edge and a second side edge;

a top edge;

a bottom edge; and a generally planar skin extending between the first and second side edges and the top and bottom edges;

the first side edge of each of the panels including a widened edge member extending entirely rearwardly of the skin, a portion of the edge member forming an abutting surface adapted for abutting contact with the skin of an adjacent panel;

first and second vertically oriented gage lines defined on the first side edge and spaced apart a first distance, each of the gage lines of the first side edge including a plurality of attachment holes, each of the attachment holes in the first gage line aligned horizontally with an attachment hole in the second gage line; and a plurality of vertically oriented gage lines defined on the skin and spaced apart a second distance, each of the gage lines of the skin including a plurality of attachment holes, each of the attachment holes in each of the gage lines aligned horizontally with an attachment hole in each of the remaining gage lines; and wherein the attachment holes of the first and second gage lines of the first side edge of each of the form panels are located on the first side edge so as to be registrable with and attachable to the attachment holes of any one of the plurality of gage lines on the skin of an adjacent panel;

whereby the column form is created upon attaching a selected one of the first and second gage lines on the first side edge of each of the form panels to a selected one of the plurality of gage lines on the skin of an adjacent one of the form panels.

2. The system of claim 1, wherein the widened edge member comprising an L-shaped member having a first leg and a second leg, the first leg having a widened faced shaped to abut the skin of the adjacent one of the form panels, the first and second gage lines of the first side edge defined in the widened face.

3. The system of claim 1, wherein the first side edge gage lines of each panel are spaced apart a first distance and further wherein the plurality of gage lines of the skin are spaced apart a second distance.

4. The system of claim 3, wherein the first distance is less than the second distance.

5. The system of claim 3, wherein the first distance is between about 2 inches and about 3 inches, and further wherein the second distance is between about 4 inches and about 6 inches.

6. The system of claim 1, further including at least one plug, the plug being adapted for placement in an unused one of the plurality of attachment holes in the skin of at least one of the panels.

7. The system of claim 6, wherein the unused one of the attachment holes on the skin includes a countersunk portion, and further wherein the plug includes a shank and a head, the head of the plug including an end surface, the plug being sized to fit in the countersunk portion so that the plug head cooperates with the skin to form a generally uninterrupted planar surface.

8. The system of claim 1, wherein at least one of the plurality of attachment holes on the skin is unused and includes a countersunk portion, and further including a plug adapted for placement in the unused hole, the plug including a head portion, the head portion cooperating with the countersunk portion to define with the skin a generally continuous planar surface.

9. The system of claim 1, wherein each of the panels includes a top stiffener adjacent the top edge and a bottom stiffener adjacent the bottom edge, the top and bottom stiffeners extending between the first and second side edges.

10. The system of claim 9, wherein each of the panels includes at least one intermediate stiffener.

11. The system of claim 10, wherein each of the top, bottom, and intermediate stiffener are Z-shaped members.

12. The system of claim 1, including a plurality of intermediate stiffeners extending between the first and second side edges of each of the panels, and further wherein each of the attachment holes on the skin of each of the panels extends through one of the stiffeners.

13. The system of claim 12, wherein at least one of the attachment holes is unused, and further including a plug having a head and being adapted for placement in the unused hole, the plug engaging at least a portion of the stiffener so that the plug head forms with the skin a generally uninterrupted planar surface.

14. A system for constructing a concrete column form, the system comprising:

a plurality of form panels, each of the form panels having a first side edge, a second side edge, a top edge, a bottom edge, and a generally planar skin, the first side edge of each of the panels including a widened edge member extending entirely rearwardly of the skin, a portion of the edge member forming an abutting surface adapted for abutting contact with the skin of art adjacent panel, each of the form panels further including:

first and second vertically oriented gage lines defined on the first side edge, the first and second gage lines of the first side edge spaced apart a first distance, each of the gage lines of the first side edge including a plurality of attachment holes, each of the attachment holes in the first gage line of the first side edge and a corresponding attachment hole in the second gage line of the first side edge spaced equidistantly from the top edge; and a plurality of vertically oriented gage lines defined on the skin and spaced apart a second distance greater than the first distance, each of the gage lines of the skin including a plurality of attachment holes, each of the attachment holes in each of the gage lines of the skin aligned with a corresponding attachment hole in an adjacent gage line of the skin, each attachment hole of the skin and its corresponding attachment hole of the skin spaced equidistantly from the top edge; and wherein the attachment holes of the first and second gage lines of the first side edge of each panel are disposed and spaced on the first side edge so as to permit registration with and attachment to the attachment holes of any one of the gage lines on the skin on an adjacent panel when the top edges of the adjacent panels are horizontally aligned.

15. The system of claim 14, wherein the widened edge member is an L-shaped member and is adapted to abut the skin of its adjacent panel.

16. The system of claim 14, wherein at least one of the plurality of skin attachment holes is unused an includes a countersunk portion, and further including a plug adapted for placement in the unused hole, the plug including a head portion, the head portion cooperating with the countersunk portion to define with the skin a generally continuous planar surface.

17. The system of claim 14, including a plurality of intermediate stiffeners extending between the first and second side edges, and further wherein each of the attachment holes extends through one of the stiffeners.

18. The system of claim 17, wherein at least one of the attachment holes on the skin is unused and further including a plug having a head and being adapted for placement in the unused hole, the plug engaging at least a portion of the stiffener so that the plug head forms with the skin a generally uninterrupted planar surface.

19. The system of claim 17, wherein each of the top, bottom, and intermediate stiffeners are Z-shaped members.

20. A form system for use in constructing a concrete column form, the form system comprising:

four panels, each panel including:

a top edge;

a bottom edge;

a first side edge, the first side edge including only a pair of gage lines, the pair of gage lines including first and second vertically oriented gage lines, each of the gage lines including a plurality of round holes, each of the round holes in the first gage line horizontally aligned with an adjacent round hole in the second gage line;

a second side edge; and a generally planar skin, the skin including a plurality of vertically oriented gage lines, each of the gage lines of the skin including a plurality of round holes, each hole in each of the gage lines horizontally aligned with an adjacent hole in a next adjacent gage line;

the first side edge of each of the panels including widened edge member extending entirely rearwardly of the skin, a portion of the edge member forming an abutting surface adapted for abutting contact with the skin of an adjacent panel; and wherein the attachment holes of the first and second gage lines of the first side edge of each panel are disposed to permit registration with and attachment to the attachment holes of any one of the gage lines on the skin of an adjacent panel when the top edges of the panel and the adjacent panel are aligned.

21. The column form of claim 20, wherein the widened edge member includes an L-shaped edge member adapted to abut the skin of its adjacent panel.

22. The column form of claim 20, wherein the gage lines of the first side edge of each of the panels are spaced apart a first distance and further wherein the gage lines on the skin of each of the panels are spaced apart a second distance, thereby permitting the attachment of the first side edge of each of the panels to the skin of the adjacent panel to be adjusted in increments equal to the first distance.

23. The column form of claim 20, wherein each of the panels includes a plurality of Z-shaped stiffeners extending between the first and second side edges, the Z-shaped stiffeners having a web shorter than the widened face.

24. The form system of claim 20, wherein the first and second gage lines of the first side edge are spaced apart a distance A, each of the gage lines of the skin are spaced apart a distance B, the distance B greater than the distance A, the distances A and B sized so that the first side edge of each of the panels is attachable to the skin of the adjacent panel in a number of possible positions, and wherein the number of possible positions is equal to two times the number of gage lines on the skin.

25. The form system of claim 20, wherein the first and second gage lines of the first side edge are spaced apart a distance A, each of the gage lines of the skin are spaced apart a distance B, the distance B greater than the distance A, the distances A and B sized so that the first side edge of each of the panels is attachable to the skin of the adjacent panel in a number of possible positions, the number of possible positions equal to two times the number of gage lines on the skin, and wherein the distances A and B are sized so that each of the number of possible positions is spaced apart relative to the skin of the adjacent panel by the distance A.

26. The form system of claim 20, wherein the first and second gage lines of the first side edge are spaced apart a distance A, each of the gage lines of the skin are spaced apart a distance, the distance B greater than the distance A, the distances A and B sized so that the first side edge of each of the panels is attachable to the skin of the adjacent panel in a number of possible positions, the number of possible positions equal to two times the number of gage lines on the skin, and wherein a first one of the possible positions is spaced from a next adjacent position by the distance A, and wherein a second one of the possible positions is spaced from another next adjacent position by a distance equal to the distance B minus the distance A.

27. A method of constructing a concrete column form having a desired one of a plurality of available cross-sectional dimensions, the method comprising the steps of:

choosing the desired cross-sectional dimension to be constructed;

providing a plurality of form panels, each of the form panels having first and second side edges, top and bottom edges, and a generally planar interconnecting skin, the first side edge of each of the panels including a widened edge member extending entirely rearwardly of the skin, a portion of the edge member forming an abutting surface adapted for abutting contact with the skin of an adjacent panel;

providing the first side edge of each of the panels with a plurality of attachment holes arranged in a plurality of vertically oriented gage lines, each of the attachment holes in a first one of the plurality of gage lines horizontally aligned with an adjacent attachment hole in an adjacent and second one of the plurality of gage lines;

providing the skin of each of the panels with a plurality of attachment holes arranged in a plurality of vertically oriented gage lines, each of the attachment holes in the skin horizontally aligned with an adjacent attachment hole in an adjacent gage line;

aligning the top edge and the bottom edge of each of the panels with the top edge and the bottom edge of an adjacent panel; and securing the attachment holes from a selected one of the gage lines on the first side edge of each panel to the attachment holes from a selected one of the first and second gage lines on the skin of an adjacent panel.

28. The method of claim 27, including the steps of:

separating the first and second gage lines on the first side edge of each of the panels by a distance A; and separating the plurality of gage lines on the skin by a distance B, the distance B greater than the distance A.

29. The method of claim 27, wherein the first and second gage lines of the first side edge are spaced apart a distance A, the plurality of gage lines of the skin are spaced apart a distance B, and securing the second gage line on the first side edge of each panel to the selected gage line on the skin of the adjacent panel, such that the panel is moved relative to the skin of the adjacent panel a distance equal to the distance A.

30. The method of claim 27, wherein the first and second gage lines of the first side edge are spaced apart a distance A, the plurality of gage lines of the skin are spaced apart a distance B, and securing the selected gage line on the first side edge of each panel to a selected second gage line on the skin of the adjacent panel, such that the panel is moved relative to the skin of the adjacent panel a distance equal to the distance A.

31. The method of claim 27, including the steps of providing a first set of the form panels and providing a second set of the form panels, the first set of the form panels having a first spacing between the first side edge gage lines and second spacing between the skin gage lines, the second set of the form panels having a third spacing between the first side edge gage lines and a fourth spacing between the skin gage lines, selecting a first pair of the form panels from the first set of the form panels, selecting a second pair of the form panels from the second set of the form panels, and placing the form panel from the first pair between the form panels from the second pair.

* * * * *